US009958223B1

(12) United States Patent
McGinty

(10) Patent No.: US 9,958,223 B1
(45) **Date of Patent: *May 1, 2018**

(54) AMBIDEXTROUS BOLT CATCH AND FIREARM

(71) Applicant: FALKOR SID, Inc., Kalispell, MT (US)

(72) Inventor: Aaron A. McGinty, Kalispell, MT (US)

(73) Assignee: FALKOR SID, INC., Kalispell, MT (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/418,565

(22) Filed: Jan. 27, 2017

Related U.S. Application Data

(60) Continuation of application No. 14/945,131, filed on Nov. 18, 2015, now Pat. No. 9,599,419, which is a division of application No. 14/594,924, filed on Jan. 12, 2015, now Pat. No. 9,417,020.

(60) Provisional application No. 61/925,768, filed on Jan. 10, 2014, provisional application No. 61/974,322, filed on Apr. 2, 2014.

(51) Int. Cl.
*F41A 3/42* (2006.01)
*F41A 3/72* (2006.01)
*F41A 35/06* (2006.01)

(52) U.S. Cl.
CPC ..... *F41A 3/42* (2013.01); *F41A 3/72* (2013.01); *F41A 35/06* (2013.01)

(58) Field of Classification Search
CPC ..... F41A 3/12; F41A 3/14; F41A 3/16; F41A 3/18; F41A 3/20; F41A 3/22; F41A 3/26; F41A 3/28; F41A 3/30; F41A 3/32; F41A 3/34; F41A 3/36; F41A 3/38; F41A 3/42; F41A 3/44; F41A 3/48; F41A 3/50; F41A 3/52; F41A 35/06
USPC ..... 89/137, 138, 173, 174, 175, 176, 180, 89/187.01, 188, 189, 190
See application file for complete search history.

(56) References Cited

U.S. PATENT DOCUMENTS 9,599,419 B2 * 3/2017 McGinty ..... F41A 35/06

* cited by examiner

*Primary Examiner* — Bret Hayes
(74) *Attorney, Agent, or Firm* — Bennet K. Langlotz; Langlotz Patent & Trademark Works, Inc.

(57) ABSTRACT

Firearms where the bolt catch can be released from either side using the same or a substantially similar motion using contact features that look, feel, or operate similarly on both sides, that are located within the firearm rather than externally, that can be used more easily or reliably, or a combination thereof. In some embodiments, a bolt catch engagement feature, magazine release mechanism, or both, are also (e.g., similarly) ambidextrous. In many embodiments, a user action on one side of the firearm is substantially similar to, but in the opposite direction from, a user action on the other side that performs the same function. In various embodiments, a left button, pad, or feature is directly opposite and in line with a right button, pad, or feature. Bolt catches can use two levers and magazine release mechanisms can use two parallel elongated members perpendicular to the barrel and a catch actuator.

4 Claims, 10 Drawing Sheets

SECTION C-C
W/BOLT CATCH DISENGAGED

DETAIL D
W/BOLT CATCH ENGAGED

DETAIL B

DETAIL A

DETAIL D
W/BOLT CATCH ENGAGED

SECTION C-C
W/BOLT CATCH DISENGAGED

DETAIL E

SECTION B-B

SECTION A-A

WITH LEFT/RIGHT SIDE MAGIZINE CATCH BUTTON NOT DEPRESSED.
MAGIZINE CAN NOT BE REMOVED.

SECTION C-C

SECTION A-A
WITH RIGHT SIDE MAGIZINE CATCH BUTTON DEPRESSED.
MAGIZINE CAN BE REMOVED.

SECTION D-D

SECTION A-A
WITH LEFT SIDE MAGIZINE CATCH BUTTON DEPRESSED.
MAGIZINE CAN BE REMOVED.

AMBIDEXTROUS BOLT CATCH AND FIREARM

RELATED PATENT APPLICATIONS

This patent application is a continuation patent application of, and claims priority to, U.S. patent application Ser. No. 14/945,131, filed on Nov. 18, 2015, titled AMBIDEXTROUS BOLT CATCH AND FIREARM, which is a divisional patent application of, and claims priority to, U.S. patent application Ser. No. 14/594,924, filed on Jan. 12, 2015, titled AMBIDEXTROUS BOLT CATCH AND MAGAZINE RELEASE AND FIREARM, which is a non-provisional patent application of, and claims priority to U.S. Provisional Patent Application No. 61/925,768, filed on Jan. 10, 2014, titled AMBIDEXTROUS BOLT CATCH OF FIREARM, and to U.S. Provisional Patent Application No. 61/974,322, filed on Apr. 2, 2014, titled AMBIDEXTROUS MAGAZINE RELEASE AND FIREARM, all of which have at least one inventor in common with the current patent application and the same assignee. The contents of these priority patent applications are incorporated herein by reference.

FIELD OF THE INVENTION

Various embodiments of this invention relate to firearms. Particular embodiments relate to firearms having bolt catches located on both sides of the firearm.

BACKGROUND OF THE INVENTION

Firearms have been used for several centuries for various purposes including as weapons for warfare, law enforcement, self defense, hunting, and target practice. Although many new weapons and weapon systems have been developed, firearms are still widely used and soldiers are trained in firearm use and carry firearms in essentially all armies throughout the world. Over time, firearms have been improved in many ways, but opportunities for improvement still exist in particular areas and for particular aspects of these devices.

Firearms have been constructed with a magazine that holds ammunition for the firearm. Magazines have been used that can be changed out quickly when one magazine is empty, speeding up the process of reloading the firearm. Magazines have been attached to the remainder of the firearm with a latch or catch, and a release mechanism, such as a button or lever, has been used to release the catch and thereby release the magazine, for instance, so a full magazine can be installed in its place.

In addition, firearms have been constructed with a bolt catch that retains the bolt or carrier in an aft or pulled position when the last round in the magazine is fired. The bolt catch allows the operator to change the magazine, release the bolt catch, and continue firing, without charging the weapon (e.g., pulling the charging handle). In this manner, the bolt catch makes it easier and quicker to reload the firearm. In a number of firearms, the bolt catch can also be used to hold the bolt or carrier back or open for other purposes, for example, to clear a jam or malfunction within the weapon, or to inspect the chamber.

Bolt catches have been made with a lever that pivots about a point of rotation and that have a bolt release pad that an operator presses (e.g., with a thumb or finger) to release the bolt. In a number of firearms, the lever also has a bolt engagement pad or feature that the operator can press while the bolt is retracted to engage the bolt catch and hold the bolt or carrier back, e.g., when the magazine is not engaged. Typically, the bolt release pad and the bolt engagement pad are located on the same side of the firearm and are activated or operated by the user by pressing the appropriate pad or feature to release the bolt or engage the catch.

Ambidextrous bolt catch release levers have been sold that extend around the exterior of the firearm to the other side of the firearm so the bolt catch can be released from the opposite side of the firearm. In some applications, an extended bolt catch lever allows the user to engage and release the bolt catch from one side of the firearm and to also release the bolt catch from the other side of the firearm. In the prior art, however, it was not possible or practical to engage the bolt catch from both sides of the firearm. Moreover, in prior art ambidextrous bolt catch release levers, the operation of the bolt catch release was different on opposite sides of the weapon. The differences in operation of the bolt catch lever on the two sides of the firearm made operation of the bolt catch complicated.

In addition, magazine releases have been made with a magazine release feature, pad, or button, that an operator presses (e.g., with a thumb or finger) to release the magazine. Typically, the magazine release button is located on one side of the firearm and is activated or operated by the user by pressing the button to release the magazine. For example, the button can be attached to or be part of a rod that extends through the lower receiver of the firearm, and pressing on the button can cause the rod to translate, against the force of a spring, to move an arm on the opposite side of the lower receiver from the button, to release a catch and release the magazine.

Ambidextrous magazine release mechanisms have been sold that include a lever on the opposite side of the firearm from the stock magazine release button. The user can press on the lever to move the arm, rod, and button, to release the catch. In such prior art ambidextrous magazine releases, however, the lever is not in the same location on the firearm as the button, and activation of the lever is not the same motion as activation of the button. In addition, in prior art ambidextrous magazine release mechanisms, the operation of the release was different on opposite sides of the weapon.

The differences in operation of the bolt catch lever on the two sides of the firearm and the differences in the operation of the magazine release on the two sides of the firearm resulted in operator errors, particularly in stressful situations, such as protracted firefights, when the operator was fatigued, when the operator was not very experienced with the firearm, or when the operator was wounded or injured. In addition, ambidextrous bolt release levers that extended around or along the outside of the firearm (e.g., the lower receiver) and ambidextrous magazine releases that used a lever on the outside of the firearm were at risk of damage, snagging on things, collecting debris, etc.

Needs or potential for benefit or improvement exist for firearms wherein the bolt catch can be engaged and released from either side of the weapon, the magazine can be released from either side of the weapon, or both, using the same or a substantially similar motion on either side, using levers, pads, or other features that look, feel, or operate similarly on both sides of the firearm, that are located more within the firearm (e.g., within the lower receiver) rather than externally, that can be used more easily or more quickly, that are more robust, or a combination thereof, as examples. Room for improvement exists over the prior art in these and other areas that may be apparent to a person of skill in the art having studied this document.

SUMMARY OF PARTICULAR EMBODIMENTS OF THE INVENTION

This invention provides, among other things, firearms with improved systems and methods of holding the bolt or carrier of the weapon back or open and releasing the bolt or carrier when appropriate to do so. Various embodiments provide firearms with improved systems and methods of catching the bolt or carrier of the weapon when the last round is fired, and releasing the bolt or carrier when a new magazine has been loaded into the firearm.

Various embodiments provide, for example, as an object or benefit, that they partially or fully address or satisfy one or more of the needs, potential areas for benefit, or opportunities for improvement described herein, or known in the art, as examples. Certain embodiments provide firearms wherein the bolt catch can be engaged, the bolt catch can be released, the magazine can be released, or a combination thereof, from either side of the weapon using the same or a substantially similar motion on either side, using levers, pads, or other features that look, feel, or operate similarly on both sides of the firearm, that are located more within the firearm (e.g., within the lower receiver) rather than externally, that can be used more easily or more quickly, that are more robust, or a combination thereof, as examples.

Other embodiments, besides firearms, include bolt catches for firearms, in some embodiments, combined with magazine releases and magazine catches for firearms, and methods of configuring, obtaining, or providing a firearm wherein the bolt catch can be engaged or released (or both) from either side of the weapon using the same or a substantially similar motion on either side, wherein the magazine can be released from either side of the weapon using the same or a substantially similar motion on either side, or both.

In a number of embodiments, improvements to firearms herein provide for firearms that are more reliable, that last longer, that are more adaptable, that can be used in conditions that are more extreme, that handle abuse well, that work better, that are easier to use, that are easier to maintain, that are less expensive to manufacture, that have a lower lifecycle cost, that offer more options for use, that can be fired more easily for a longer period of time, or a combination thereof, in comparison with certain alternatives.

Specific embodiments include various firearms that each include, for example, a bolt, a carrier (or both), a bolt catch that holds the bolt or the carrier in a retracted position, a left bolt release feature at the left side of the firearm, and a right bolt release feature at the right side of the firearm (e.g., opposite the left side). In a number of embodiments, the left bolt release feature is actuated with a first user action to release the bolt catch, and the right bolt release feature is actuated with a second user action to release the bolt catch. Further, in various embodiments, the first user action and the second user action are substantially similar but in opposite directions.

Some embodiments further include a left bolt engagement feature at the left side and a right bolt engagement feature at the right side. Moreover, in a number of embodiments, the left bolt engagement feature is actuated with a third user action, and the right bolt engagement feature is actuated with a fourth user action, and the third user action and the fourth user action are substantially similar but in opposite directions. Further, in particular embodiments, the first user action is an application of a first pushing force substantially perpendicular to the left side of the firearm and the second user action is an application of a second pushing force substantially perpendicular to the right side of the firearm.

Still further, in certain embodiments, the left bolt release feature includes a left bolt release pad at the left side, the right bolt release feature includes a right bolt release pad at the right side, and the left bolt release pad is substantially opposite the right bolt release pad. Similarly, in some embodiments, the left bolt engagement feature is substantially opposite the right bolt engagement feature. Further still, in some embodiments, the third user action is an application of a third pushing force substantially perpendicular to the left side of the firearm and the fourth user action is an application of a fourth pushing force substantially perpendicular to the right side of the firearm.

Even further, in a number of embodiments, the bolt catch includes a left lever that extends to the left side of the firearm and a right lever that extends to the right side of the firearm. Even further still, in certain embodiments, the bolt catch includes a left pivot point of the left lever, the left lever rotates about the left pivot point when the left lever is actuated, the left pivot point is between the left side and the right side, and the left pivot point is closer to the left side than the right side. Similarly, in some embodiments, the bolt catch includes a right pivot point of the right lever, the right lever rotates about the right pivot point when the right lever is actuated, the right pivot point is between the left side and the right side, and the right pivot point is closer to the right side than the left side. Moreover, in some embodiments, the left lever engages the bolt or carrier and the right lever engages the left lever. In other embodiments, however, the right lever engages the bolt or carrier and the left lever engages the left lever.

Various embodiments of firearms further include, for example, an ammunition magazine that holds ammunition for the firearm, a receiver to which the ammunition magazine attaches, a magazine catch that attaches the ammunition magazine to the receiver of the firearm, and a magazine release mechanism that releases the magazine catch. In a number of embodiments, the magazine release mechanism includes a left magazine release button on the left side of the firearm and a right magazine release button on the right side of the firearm. Moreover, in various embodiments, the magazine release mechanism is configured so that pressing on the left magazine release button with a first user action causes the magazine catch to release the ammunition magazine from the receiver. Similarly, in a number of embodiments, the magazine release mechanism is configured so that pressing on the right magazine release button with a second user action causes the magazine catch to release the ammunition magazine from the receiver. Further, in various embodiments, the left magazine release button is directly opposite and in line with the right magazine release button.

Further, in some embodiments, the first user action and the second user action are substantially similar but in opposite directions. Still further, in a number of embodiments, the left magazine release button and the right magazine release button are opposite ends of an elongated magazine release member, for example, that extends through the receiver from the left side of the firearm to the (e.g., opposite) right side of the firearm. Further still, some embodiments include an elongated magazine catch member having a second long axis, for instance, that is parallel to a first long axis of the magazine release member. Even further, certain embodiments include a catch actuator, for example, located between the elongated magazine release member and the elongated magazine catch member. In different embodiments, for example, the catch actuator is a ball or a pin.

Still further, various embodiments include a guide, for example, located between the elongated magazine release member and the elongated magazine catch member. In a number of embodiments, for instance, the guide is stationary with respect to the left side and the right side of the firearm, and the guide guides motion of the catch actuator when the magazine release member moves. Even further still, in some embodiments, there is a first indentation within the elongated magazine release member for the catch actuator, a second indentation within the elongated magazine catch member for the catch actuator, or both. Moreover, certain embodiments include a spring, for example, that is concentric with the elongated magazine catch member. Furthermore, some embodiments include an arm, for example, extending from the elongated magazine catch member to the magazine catch.

Even further, various embodiments include firearms that include magazine release buttons on opposite sides that are substantially opposite as well as catch release pads on opposite sides that are substantially opposite. Various embodiments include, for example, an ammunition magazine that holds ammunition for the firearm, a receiver to which the ammunition magazine attaches, a magazine catch that attaches the ammunition magazine to the receiver of the firearm, and a magazine release mechanism that releases the magazine catch. Further, a number of embodiments include a left magazine release button on the left side of the firearm, a right magazine release button on the opposite right side of the firearm, a bolt catch that holds the bolt or the carrier in a retracted position, a left bolt catch release pad on the left side of the firearm, and a right bolt catch release pad on the right side of the firearm. Still further, in various embodiments, pressing on the left magazine release button causes the magazine catch to release the ammunition magazine from the receiver, pressing on the right magazine release button causes the magazine catch to release the ammunition magazine from the receiver, pressing on the left bolt catch release pad causes the bolt catch to release the bolt or the carrier from the retracted position, and pressing on the right bolt catch release pad causes the bolt catch to release the bolt or the carrier from the retracted position. Even further, in a number of embodiments, the left magazine release button is substantially opposite the right magazine release button, and the left catch release pad is substantially opposite the right catch release pad.

In addition, various other embodiments of the invention are also described herein, and other benefits of certain embodiments may be apparent to a person of skill in this area of technology.

BRIEF DESCRIPTION OF THE DRAWINGS

The drawings provided herewith illustrate, among other things, examples of certain aspects of particular embodiments. Other embodiments may differ. Various embodiments may include aspects shown in the drawings, described in the specification (including the claims), known in the art, or a combination thereof, as examples. Other embodiments, however, may differ.

DETAILED DESCRIPTION OF EXAMPLES OF EMBODIMENTS

This patent application describes, among other things, examples of certain embodiments, and certain aspects thereof. Other embodiments may differ from the particular examples described in detail herein. Various embodiments are or concern firearms, for example, having improvements over the prior art. Different embodiments include firearms, mechanisms for firearms, and methods concerning bolt catches for firearms, and methods concerning magazine releases for firearms, as examples. In certain embodiments, the firearm is an AR-15 or an M-16, as examples.

In various embodiments of firearms, the bolt catch, magazine, or both, are released from either side of the weapon using the same or a substantially similar motion, for instance, using contact features that look, feel, or operate similarly on both sides of the firearm, or a combination thereof. In a number of embodiments, mechanisms are located within the firearm rather than externally, can be used more easily or more reliably, or a combination thereof. In some embodiments, a bolt catch engagement feature is also ambidextrous. Further, in many embodiments, a user action on one side of the firearm is substantially similar to, but in the opposite direction from, a user action on the other side that performs the same function. Still further, in various embodiments, a left button, pad, or feature is (e.g., directly) opposite and in line with a right button, pad, or feature. Moreover, bolt catch mechanisms can use two levers and magazine release mechanisms can use two parallel elongated members, for example, that are perpendicular to the barrel, and a number of embodiments use a catch actuator located between the two parallel elongated members.

Figure 1:
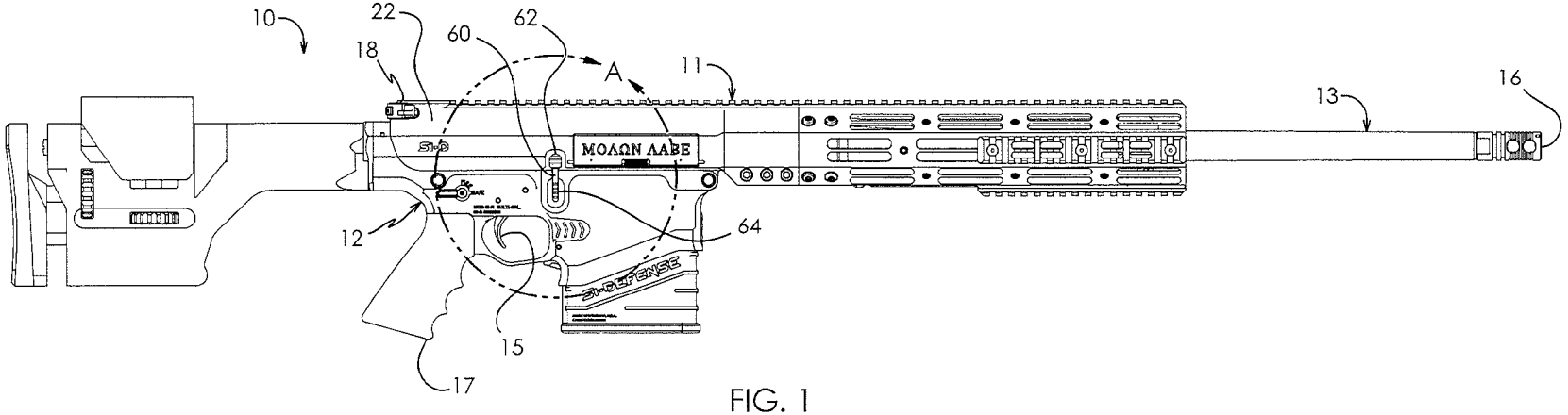
FIG. 1 is a right side view of an embodiment of a firearm that includes a bolt catch with a bolt release feature on each side of the firearm.
Figure 2:
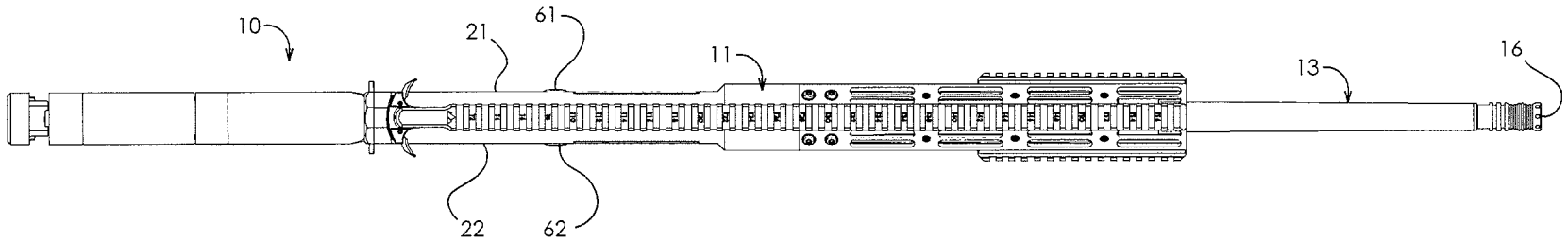
FIG. 2 is a top view of the firearm of FIG. 1.
Figure 3:
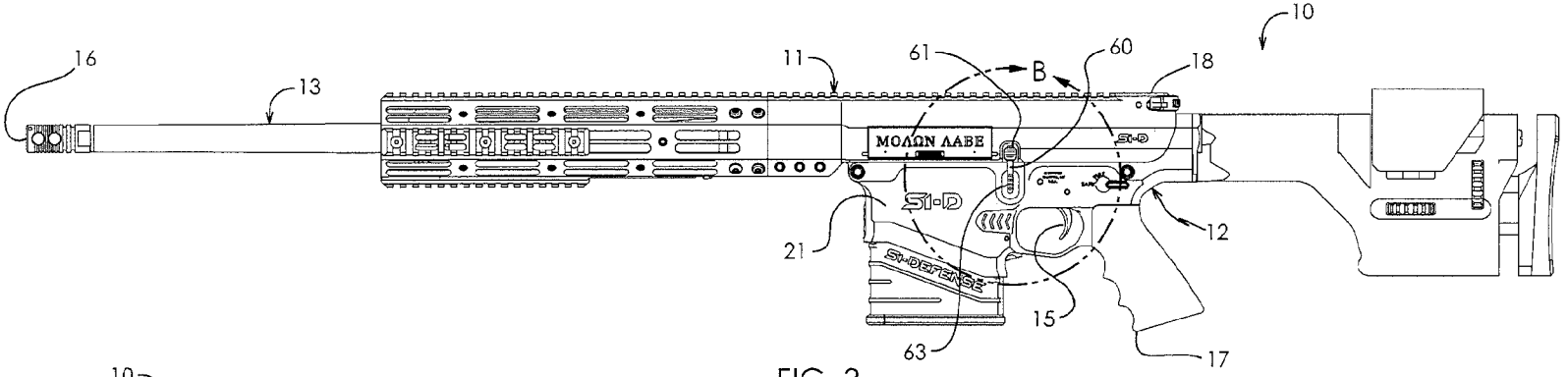
FIG. 3 is a left side view of the firearm of FIG. 1.
Figure 5:
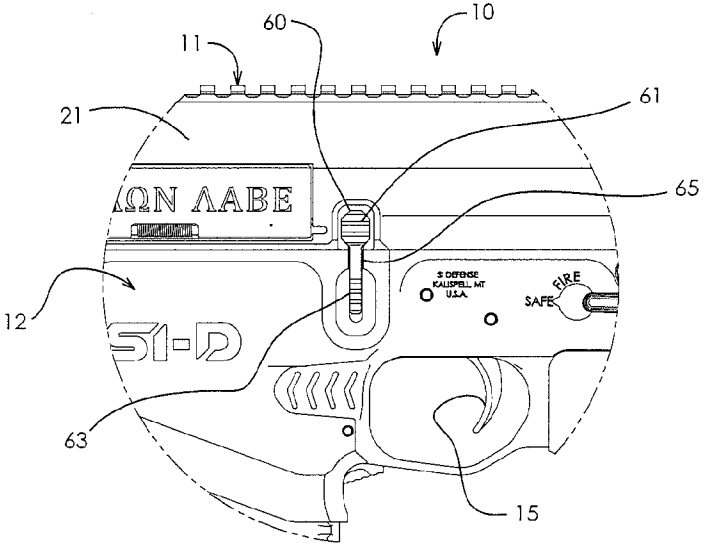
FIG. 5 is a detail view of part of the left side of the firearm of FIGS. 1-4 showing, among other things, the bolt release feature and bolt engagement feature on the left side of the firearm.
Figure 4:
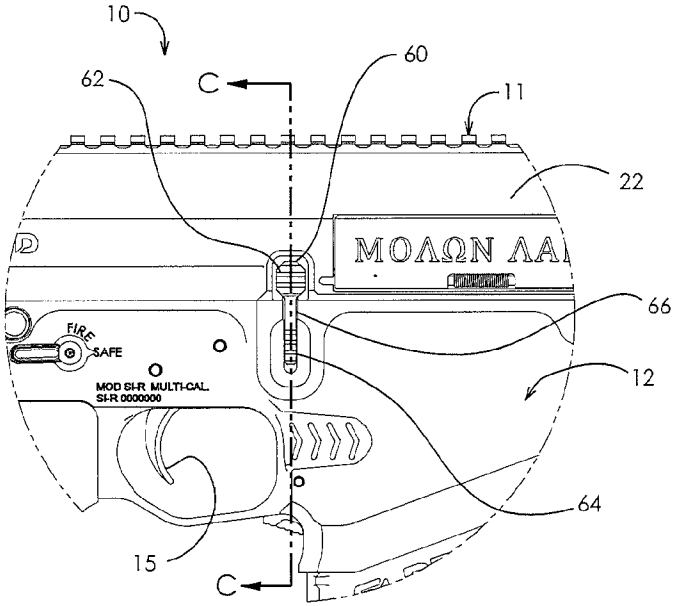
FIG. 4 is a detail view of part of the right side of the firearm of FIG. 1 showing, among other things, the bolt release feature and bolt engagement feature on the right side of the firearm.
Figure 7:
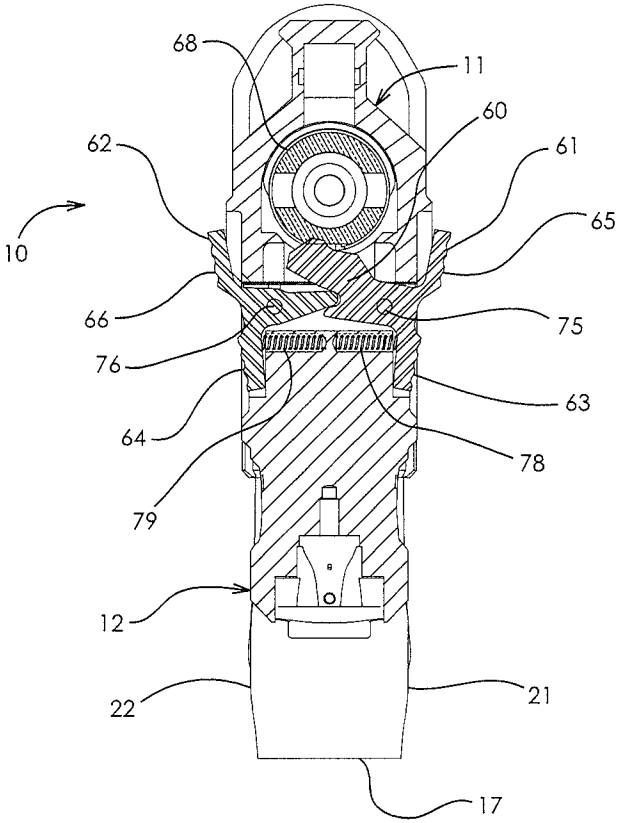
FIG. 7 is a cross-sectional front view of part of the firearm of FIGS. 1-5 showing, among other things, the left lever and the right lever of the bolt catch with the bolt catch engaged.
Figure 6:
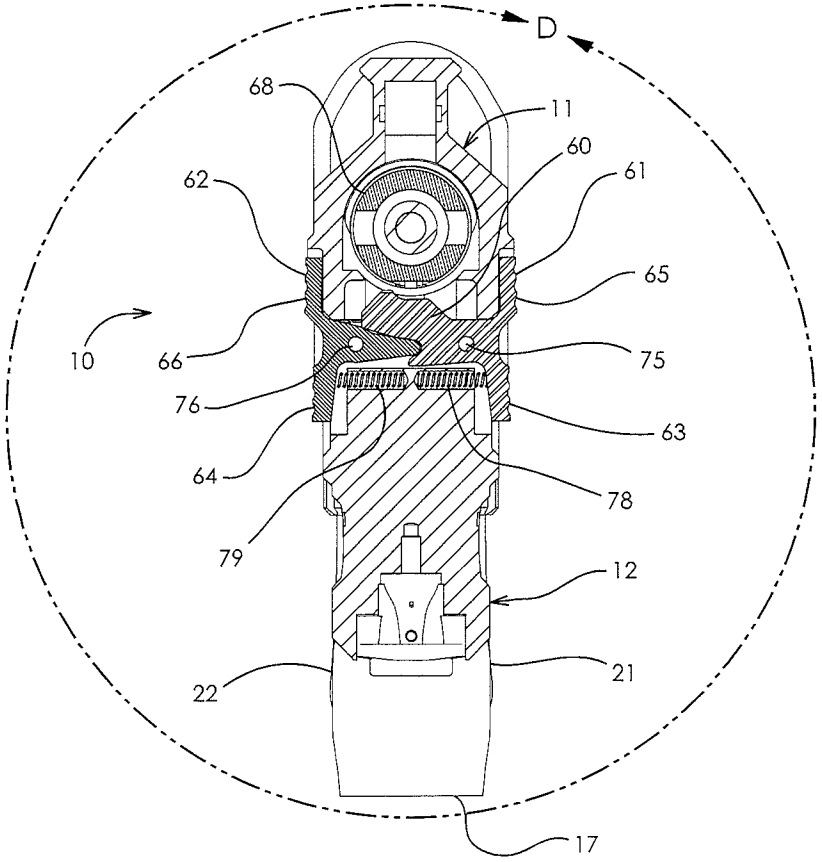
FIG. 6 is a cross-sectional front view of part of the firearm of FIGS. 1-5 showing, among other things, the left lever and the right lever of the bolt catch with the bolt catch disengaged.
Figure 8:
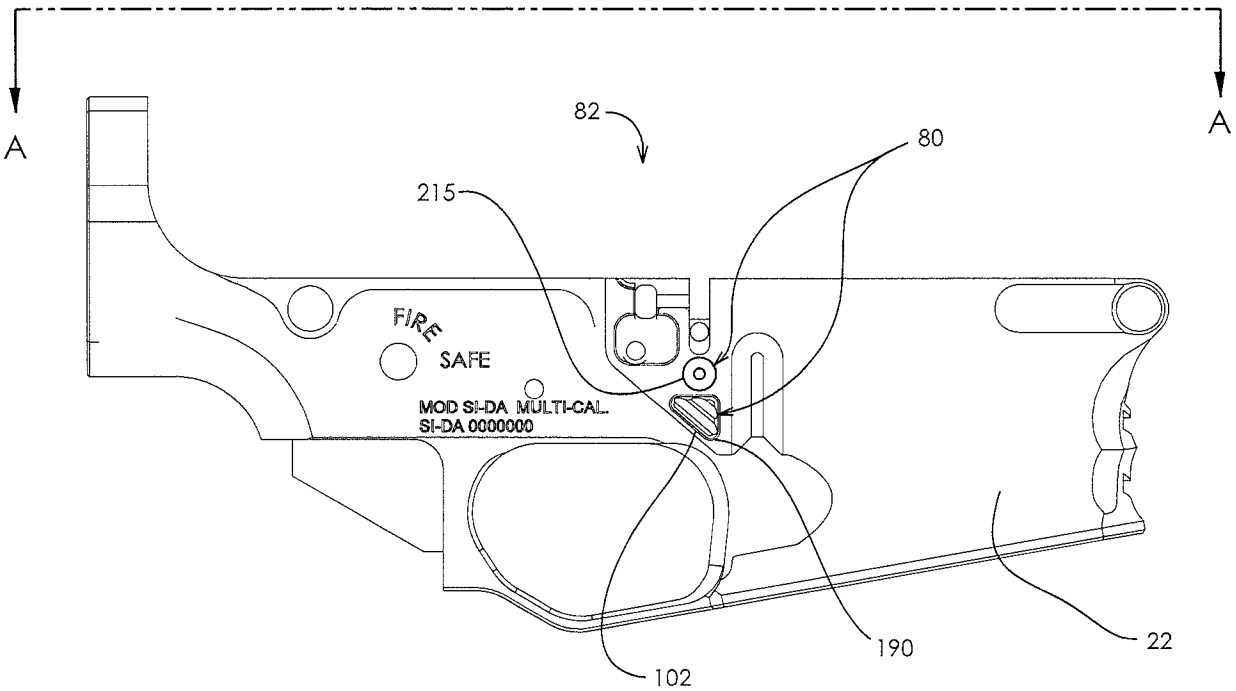
FIG. 8 is a right side view of an embodiment of a lower receiver of a firearm that includes a magazine release mechanism with a magazine release button on each side of the firearm showing, among other things, the magazine release button on the right side of the firearm.

Addressing bolt catch mechanisms first, in a number of embodiments, a firearm (e.g., 10 shown in FIGS. 1-3) includes a bolt or a carrier (e.g., 68 shown in FIGS. 6 and 7) (e.g., one or both, in various embodiments), a bolt catch (e.g., 60), for instance, that holds the bolt or the carrier (e.g., 68) in a retracted position, a left side (e.g., 21 shown in FIGS. 2 and 3), and a right side (e.g., 22 shown in FIGS. 1 and 2). As used herein, the left side and right side are on the operator's left and right, respectively, when the operator is holding the firearm (e.g., 10) in its normal orientation when being fired with the top of the firearm up. In various embodiments, the right side (e.g., 22) is opposite the left side (e.g., 21). In some embodiments, the left side (e.g., 21) and the right side (e.g., 22) are the left and right side (e.g., 22) walls or external surfaces of a lower receiver (e.g., 12) of the firearm, for example. In different embodiments, where a bolt or a carrier (e.g., 68) is described herein, or both, or a bolt carrier group, in different embodiments the firearm can have a bolt, a carrier, or both, or a bolt carrier group. Further, as used herein "retracted" when referring to a bolt, carrier, or bolt carrier group, means aft, for example, with the buffer spring partially or fully compressed, for instance, more compressed than when the weapon is ready to fire.

A number of embodiments further include (e.g., as part of the bolt catch, for instance, 60) a left catch release or left bolt release feature (e.g., 61 shown in FIGS. 3 and 5-7) at the left side (e.g., 21). In various embodiments, a contact feature or a bolt release feature (e.g., 61) can be a button, a thumb pad, a lever, or a location to press against, as examples. Further, various embodiments include a right catch release or right bolt release feature (e.g., 62 shown in FIGS. 1, 4, 6, and 7) at the right side (e.g., 22). Further still, some embodiments include a left catch engagement feature or left bolt engagement feature (e.g., 63) at the left side (e.g., 21), which can be, in a number of embodiments, a button, thumb pad, or location to press against, as examples. Even further, various embodiments include a right catch engagement feature or right bolt engagement feature (e.g., 64) at the right side (e.g., 22).

Still further, in particular embodiments, the left bolt release feature (e.g., 61) is actuated with a first user action (e.g., a pressing action, force, or vector, for instance, manually and directly applied by an operator of the firearm, for example, with the operator's finger or thumb), the right bolt release feature (e.g., 62) is actuated with a second user action, or both. Moreover, in some embodiments, the left bolt engagement feature (e.g., 63) is actuated with a third user action, the right bolt engagement feature (e.g., 64) is actuated with a fourth user action, or both. In a number of embodiments, only one of these different user actions is (e.g., need be) applied at a time (e.g., manually, by the operator of the firearm), for instance, to release or engage the bolt catch (e.g., 60). Even further, in certain embodiments, the first user action and the second user action are substantially similar but in opposite directions (e.g., opposite hand). Even further still, in particular embodiments, the third user action and the fourth user action are substantially similar but in opposite directions.

As used herein, "substantially similar", when referring to user actions, means within plus or minus 40 percent in magnitude (e.g., force), and "substantially similar but in opposite directions" means within plus or minus 40 percent in magnitude and within 30 degrees of the exact opposite direction. In other embodiments, where "substantially similar" is used herein with reference to user actions, the magnitude may be within plus or minus 5, 10, 15, 30, 30, 50, 60, 70, 80, 90, or 100 percent, as other examples. Further, in different embodiments, where "substantially similar but in opposite directions" is used herein, the other embodiments may have (or require) an angle (e.g., of the applied force vector) that is within 5, 10, 15, 20, 25, 35, 40, 45, 50, 60, 70, or 80 degrees of the exact opposite direction, as other examples.

Further, as used herein, a statement that two user actions are, for instance, similar in magnitude and direction, means the force if the minimum force necessary is applied to operate the mechanism on the firearm. It may be possible to actuate the mechanism by applying a greater force, for example, in a somewhat different direction (e.g., it may be possible to apply a much greater force at a 45 degree angle to a thumb pad rather than applying a minimal force, for instance, perpendicular to the pad). These user actions herein, however, assume that a minimum force is applied by the user in the appropriate direction to achieve the desired result (e.g., to release or engage the bolt catch).

In particular embodiments, the firearm (e.g., 10) or bolt catch (e.g., 60) includes a left bolt release pad (e.g., 61) at the left side (e.g., 21) and a right bolt release pad (e.g., 62) at the right side (e.g., 22). In various embodiments, for example, the left bolt release feature (e.g., 61) is or includes a left bolt release pad (e.g., 61) at the left side (e.g., 21), the right bolt release feature (e.g., 62) is or includes a right bolt release pad (e.g., 62) at the right side (e.g., 22), or both. In some embodiments, the left bolt release pad (e.g., 61) is substantially opposite the right bolt release pad (e.g., 62) for example. As used herein, "substantially opposite" means facing a substantially opposite direction and located in a substantially similar position on the firearm (e.g., 10), for instance, measured from the trigger (e.g., 15), from the tip or end (e.g., 16) of the barrel (e.g., 13 shown in FIGS. 1-3), from the lowest point (e.g., 17) on the lower receiver (e.g., 12), from the highest point (e.g., 18) on the upper receiver (e.g., 11), or a combination thereof, as examples. Further, as used herein, "substantially similar position" means within plus or minus one inch. In other embodiments, however, where a "substantially similar position" is indicated herein, the measurements or position may be within ⅛, ¼, ⅜, ½, ⅝, ¾, ⅞, 1.25, 1.5, 1.75, or 2 inches, as other examples, or within 5, 10, 15, 20, 25, 30, 40, or 50 percent, as still other examples. Further, in various embodiments, the left bolt engagement feature (e.g., 63) is substantially opposite the right bolt engagement feature (e.g., 64).

Another example of an embodiment is a firearm (e.g., 10) having a bolt or a carrier (e.g., 68) (or a bolt carrier group), a catch that holds the bolt or the carrier (e.g., 68) (or the group) in a retracted position, a left side (e.g., 21), a right side (e.g., 22) opposite the left side (e.g., 21), a left bolt engagement feature (e.g., 63) at the left side (e.g., 21), and a right bolt engagement feature (e.g., 64) at the right side (e.g., 22), wherein the left bolt engagement feature (e.g., 63) is substantially opposite the right bolt engagement feature (e.g., 64). A number of such embodiments also have a left bolt engagement feature (e.g., 63) at the left side (e.g., 21) and a right bolt engagement feature (e.g., 64) at the right side (e.g., 22). Some such embodiments require particular user actions, but other embodiments do not require particular user actions (e.g., substantially similar but in opposite directions).

Further, in a number of embodiments (e.g., having or requiring a first user action, for instance, to release the bolt), the first user action is an application of a first pushing force, for instance, substantially perpendicular to the left side (e.g., 21) of the firearm, for instance. As used herein, a "pushing force" is a force of a magnitude that an operator of the firearm can be expected to apply the force with the operator's hand (e.g., a finger or thumb). Further, as used herein, "substantially perpendicular" means perpendicular to within 30 degrees. Again, this assumes that the minimum force is applied that will actuate the mechanism (e.g., that will release the catch).

Further still, in various embodiments, the second user action is an application of a second pushing force substantially perpendicular to the right side (e.g., 22) of the firearm. Even further, in some embodiments, the third user action is an application of a third pushing force substantially perpendicular to the left side (e.g., 21) of the firearm. Still further, in a number of embodiments, the fourth user action is an application of a fourth pushing force substantially perpendicular to the right side (e.g., 22) of the firearm. Even further still, in some embodiments, where "substantially perpendicular" is used herein, the pushing force may be perpendicular, for example, to the side. As used herein, "perpendicular", without being preceded by "substantially", means perpendicular to within 10 degrees, unless stated otherwise.

Moreover, in various embodiments, the bolt catch (e.g., 60) includes a left lever (e.g., 65), for instance, that extends to the left side (e.g., 21) of the firearm (e.g., 10). Further, some embodiments include a left pivot point (e.g., 75) of the left lever (e.g., 65), and the left lever (e.g., 65) rotates about the left pivot point (e.g., 75), for example, when the left lever (e.g., 65) is actuated. In particular embodiments, the lever is "actuated" when the catch retains the bolt, carrier, or bolt carrier group (e.g., 68), when the operator releases the bolt catch (e.g., 60, for instance, releasing the bolt, carrier, or bolt carrier group 68, for example, with bolt release feature 61 or 62), or when the operator engages the bolt catch, for instance, via the bolt engagement feature (e.g., 63 or 64), as examples. Even further, in a number of embodiments, the left pivot point (e.g., 75) is between the left side (e.g., 21) and the right side (e.g., 22) (e.g., inside the receiver or the lower receiver, for instance, 12). Further still, in some embodiments, the left pivot point (e.g., 75) is closer to the left side (e.g., 21) than the right side (e.g., 22). In various embodiments, such a pivot point may include a pin or a fastener, such as a screw, a bushing, or a combination thereof, as examples.

In a number of embodiments, the left lever (e.g., 65) includes the left bolt release feature (e.g., 61), the left bolt release pad (e.g., 61), or both, as examples. Further, in a number of embodiments, the left lever (e.g., 65) includes the left bolt engagement feature (e.g., 63), a left catch engagement pad or a left bolt engagement pad (e.g., 63), or both, as examples. Further, in a number of embodiments, the left bolt release feature (e.g., 61) or pad is above the left bolt engagement feature (e.g., 63) or pad when the firearm (e.g., 10) is assembled and in its normal operating orientation. In some embodiments, the left lever (e.g., 65), right lever (e.g., 66), or both, are flat, for instance, in the embodiment illustrated, except for the bolt release features or pads (e.g., 61 and 62). In this context, "flat" means in the same plane and having a thickness perpendicular to the plane that does not vary by more than a factor of 3. In some embodiments, the left lever, right lever, or both, are flat and in the same plane, except for the bolt release features or pads (e.g., 61 and 62) and having a thickness perpendicular to the plane that does not vary by more than a factor of 5, 4, 3.5, 2.5, 2, or 1.5, as other examples. Further, in some embodiments, the left lever, right lever, or both, are flat and in the same plane, except for the bolt release features or pads (e.g., 61 and 62), the bolt engagement features or pads (e.g., 63 and 64) and having a thickness perpendicular to the plane that does not vary by more than a factor of 5, 4, 3.5, 3, 2.5, 2, or 1.5, as still other examples.

Further, in a number of embodiments, the bolt catch (e.g., 60) includes a right lever (e.g., 66), for example, that extends to the right side (e.g., 22) of the firearm. In particular embodiments, the firearm (e.g., 10) includes a right pivot point (e.g., 76) of the right lever (e.g., 66), and the right lever (e.g., 66) rotates about the right pivot point (e.g., 76), for instance, when the right lever (e.g., 66) is actuated. Further, in some embodiments, the right lever (e.g., 66) rotates about the right pivot point (e.g., 76) when the left lever (e.g., 65) is actuated. Moreover, in some embodiments, the left lever (e.g., 65) rotates about the left pivot point (e.g., 75) when the right lever (e.g., 66) is actuated. Further, in a number of embodiments, the right pivot point (e.g., 76) is between the left side (e.g., 21) and the right side (e.g., 22), and in certain embodiments, the right pivot point (e.g., 76) is closer to the right side (e.g., 22) than to the left side (e.g., 21).

In a number of embodiments, the right lever (e.g., 66) includes the right bolt release feature (e.g., 62), the right bolt release pad (e.g., 62), or both. Further, in a number of embodiments, the right lever (e.g., 66) includes the right bolt engagement feature (e.g., 64), a right bolt engagement pad, or both, as examples. Further, in a number of embodiments, the right bolt release feature (e.g., 62) or pad is above the right bolt engagement feature (e.g., 64).

In particular embodiments, the left lever (e.g., 65) engages the bolt, carrier, or bolt carrier group (e.g., 68), and the right lever (e.g., 66) engages the left lever (e.g., 65). As used herein, "engages" means applying a force against when activated by the operator. In other embodiments, the right lever (e.g., 66) engages the bolt, carrier, or bolt carrier group (e.g., 68), and the left lever (e.g., 65) engages the right lever (e.g., 66), as another example. Where the word "engages" is used herein in the context that a first component engages a second component, in some embodiments, the first component contacts the second component.

Further, in some embodiments, the firearm (e.g., 10) includes a left spring (e.g., 78), a right spring (e.g., 79), or both, e.g., that push, pull, or bias the left lever (e.g., 65), the right lever (e.g., 66), or both, for example, against the bolt, the carrier, or the bolt carrier group (e.g., 68), for instance. Further still, in a number of embodiments, the left spring (e.g., 78) is a helical spring, the right spring (e.g., 79) is a helical spring, the left spring is a torsion spring, the right spring is a torsion spring, or a combination thereof, as examples. In some embodiments, helical springs are also torsion springs, but other embodiments may differ in one or both of these respects. In a number of embodiments, the spring or springs (e.g., 78 and 79) bias or hold the lever or levers (e.g., 75 and 76) in one direction unless the levers are manually pushed or held in the other direction (e.g., by a user action described herein).

Another example of an embodiment is a catch or a bolt catch (e.g., 60) for a firearm. The firearm (e.g., 10) can include, for instance, a bolt, a carrier, or a bolt carrier group (e.g., 68), and the bolt catch (e.g., 60) holds the bolt, the carrier, or the bolt carrier group (e.g., 68) in a retracted position. Further, in some embodiments, the bolt catch (e.g., 60) includes a left bolt release feature (e.g., 61) a right bolt release feature (e.g., 62), a left bolt engagement feature (e.g., 63), a right bolt engagement feature (e.g., 64), or a combination thereof, for example. In some embodiments, the bolt release features (e.g., 61 and 62) are actuated with user actions, for example, as described herein. Further, in particular embodiments, (e.g., when the bolt catch is installed on the firearm), the first user action and the second user action (i.e., when applied) are substantially similar but in opposite directions, the third user action and the fourth user action (i.e., when applied) are substantially similar but in opposite directions, or both.

Figure 9:
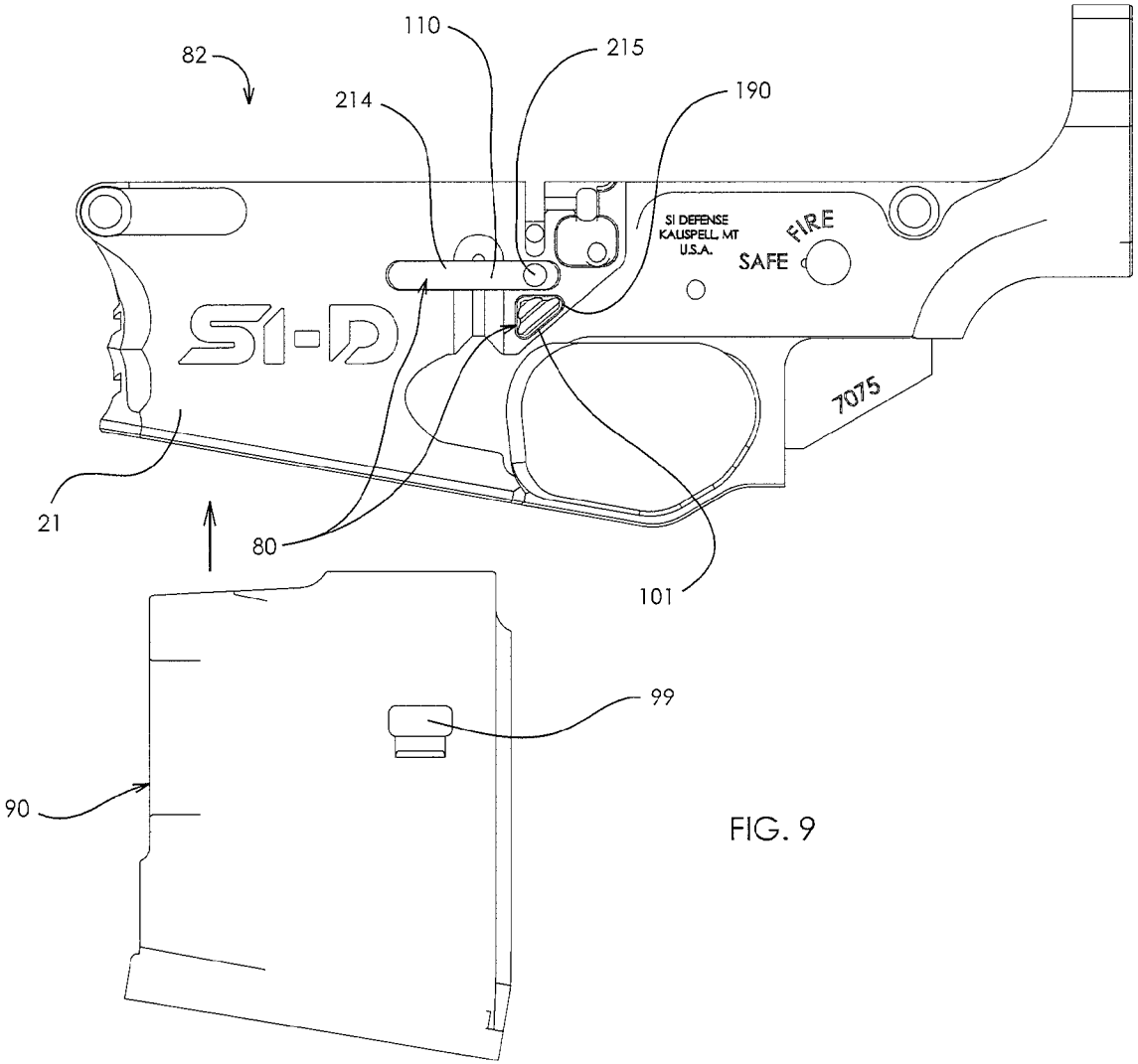
FIG. 9 is a left side view of the lower receiver of FIG. 8 and the magazine for the firearm showing, among other things, the magazine release button on the left side of the firearm.
Figure 12:
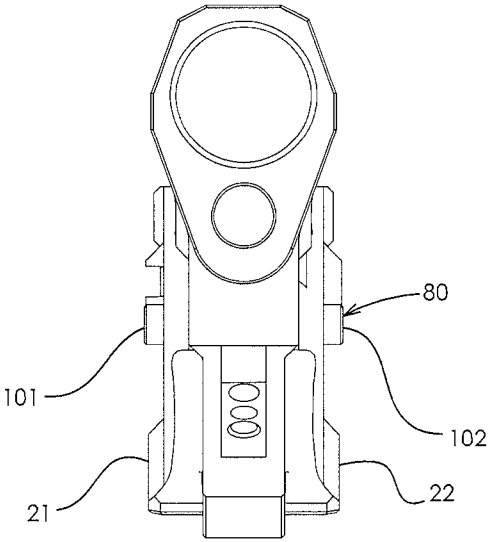
FIG. 12 is a rear view of the lower receiver of FIGS. 9-11 showing, among other things, the magazine (e.g., catch) release buttons on both sides of the firearm.

Turning now to magazine release mechanisms, in various embodiments, a firearm (e.g., 10) includes a magazine (e.g., 90 shown in FIG. 9) that holds ammunition for the firearm, a receiver (e.g., a lower receiver, for instance, 82, shown in FIGS. 8-18) to which the magazine (e.g., 90) attaches, a magazine latch or catch (e.g., 110) that holds the magazine (e.g., 90) in the receiver (e.g., lower receiver 82) of the firearm (e.g., 10), and a magazine release mechanism (e.g., 80) that releases the magazine catch (e.g., 110) to release the magazine (e.g., 90), for instance, from the lower receiver (e.g., 82) of the firearm. In the embodiments illustrated, lower receiver 82, shown in FIGS. 8-18, can be substituted for lower receiver 12 shown in FIGS. 1-7 in firearm 10. Some embodiments, however, include aspects of both lower receivers 12 and 82. Different embodiments include different combinations of the features and aspects described herein and shown on the drawings.

In some embodiments, the firearm (e.g., 10) has an upper receiver (e.g., 11) and a lower receiver (e.g., 82) and the magazine (e.g., 90) attaches to the lower receiver (e.g., 82). In a number of embodiments, the magazine release mechanism (e.g., 80) includes a left magazine catch release button or left magazine release button (e.g., 101) on the left side (e.g., 21) of the firearm, and a right magazine catch release button or right magazine release button (e.g., 102) on the right side (e.g., 22) of the firearm, which, in various embodiments, are contact features for the magazine release mechanism (e.g., 80). In a number of embodiments, the left magazine release button (e.g., 101) is on the left side (e.g., 21) of the receiver (e.g., lower receiver 82), and the right magazine release button (e.g., 102) is on the right side (e.g., 22) of the receiver (e.g., 82).

Further, in some embodiments, the magazine release mechanism (e.g., 80) is configured (e.g., manufactured, assembled, or both) so that pressing on the left magazine release button (e.g., 101), for example, with a first user action, causes the magazine catch (e.g., 110) to release the magazine (e.g., 90) from the receiver. Further still, in a number of embodiments, the magazine release mechanism (e.g., 80) is configured so that pressing on the right magazine release button (e.g., 102), for instance, with a second user action, causes the magazine catch (e.g., 110) to release the magazine (e.g., 90) from the receiver. As used herein, a mechanism being "configured" to perform a particular function means that the mechanism, or the components thereof, are specifically manufactured to perform that function, and that when assembled, for example, on a firearm, that the mechanism performs that function when actuated (e.g., when the button is pressed by the user).

Figure 10:
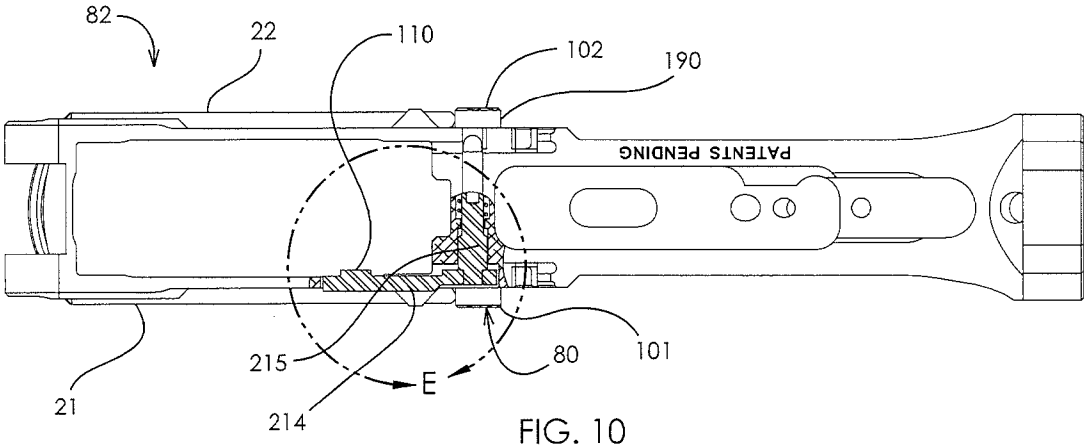
FIG. 10 is a partially cross-sectional top view of the lower receiver of FIGS. 8 and 9 showing, among other things, the magazine catch in the catch position.
Figure 11:
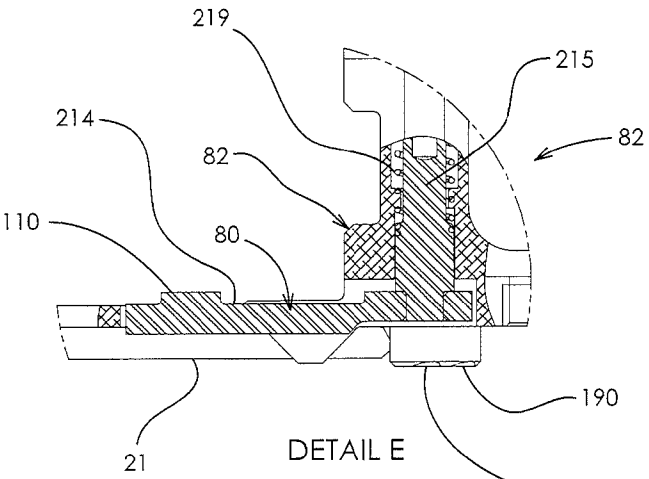
FIG. 11 is a detail cross sectional top view of part of the lower receiver of FIGS. 8-10 showing, among other things, details of the magazine release mechanism.
Figure 14:
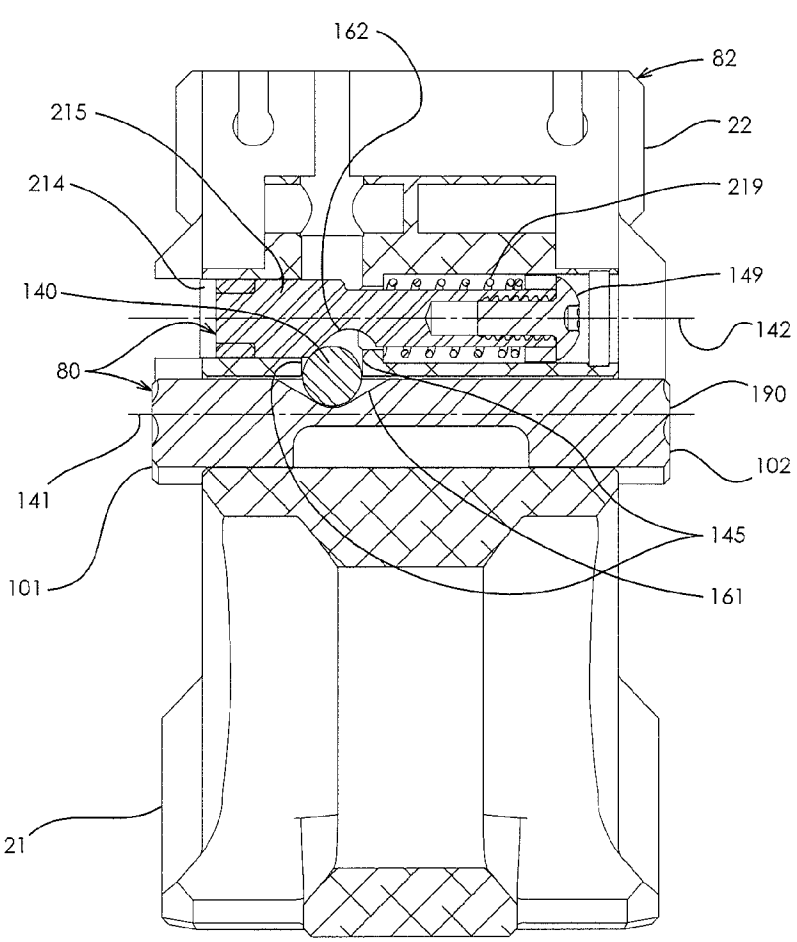
FIG. 14 is a cross-sectional rear view of the lower receiver of FIGS. 8-13, taken along section B-B in FIG. 13, showing, among other things, the magazine release buttons not depressed on both sides of the firearm.
Figure 13:
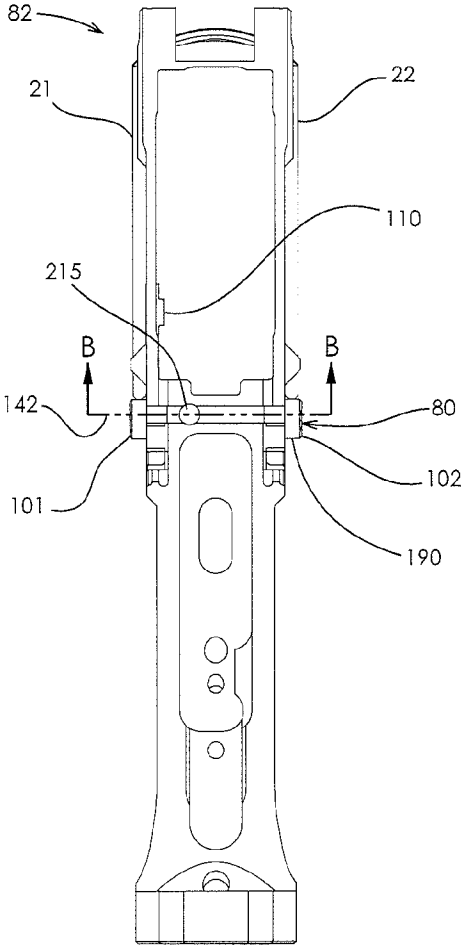
FIG. 13 is a cross-sectional top view of the lower receiver of FIGS. 9-12, taken along section A-A in FIG. 8, showing, among other things, the magazine release buttons not depressed on both sides of the firearm.
Figure 16:
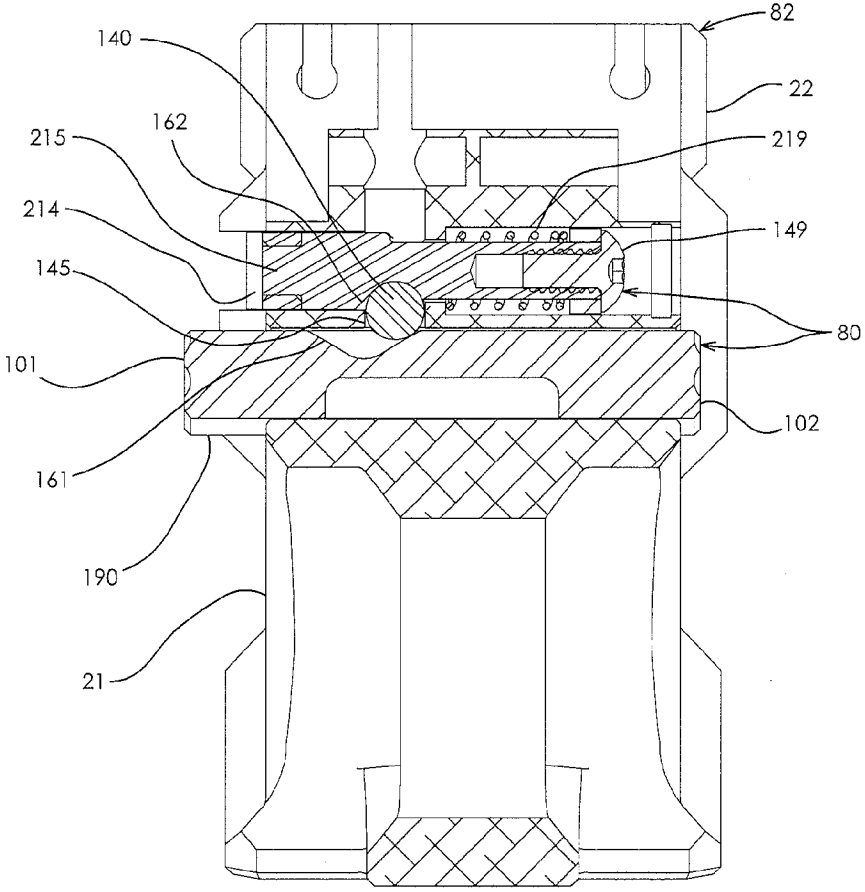
FIG. 16 is a cross-sectional rear view of the lower receiver of FIGS. 8-13, taken along section C-C in FIG. 15, showing, among other things, the right magazine release button depressed on the right side of the firearm.
Figure 15:
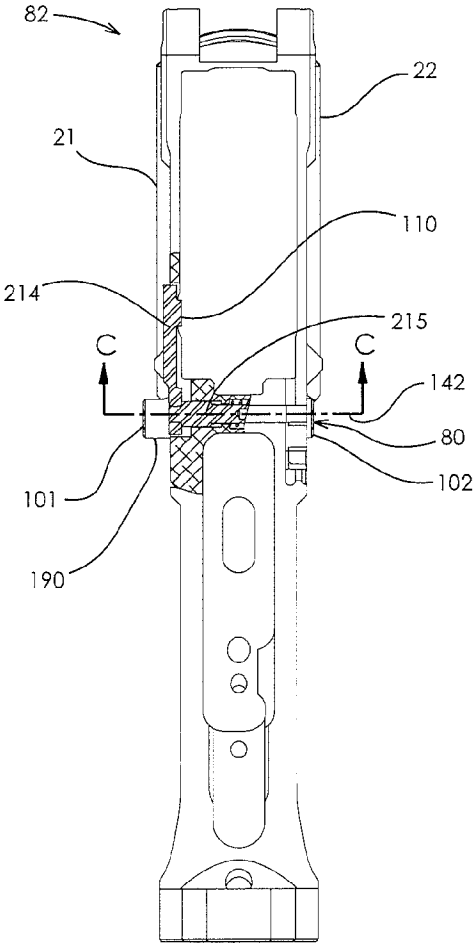
FIG. 15 is a cross-sectional top view of the lower receiver of FIGS. 8-13, taken along section A-A in FIG. 8, showing, among other things, the right magazine release button depressed on the right side of the firearm.
Figure 18:
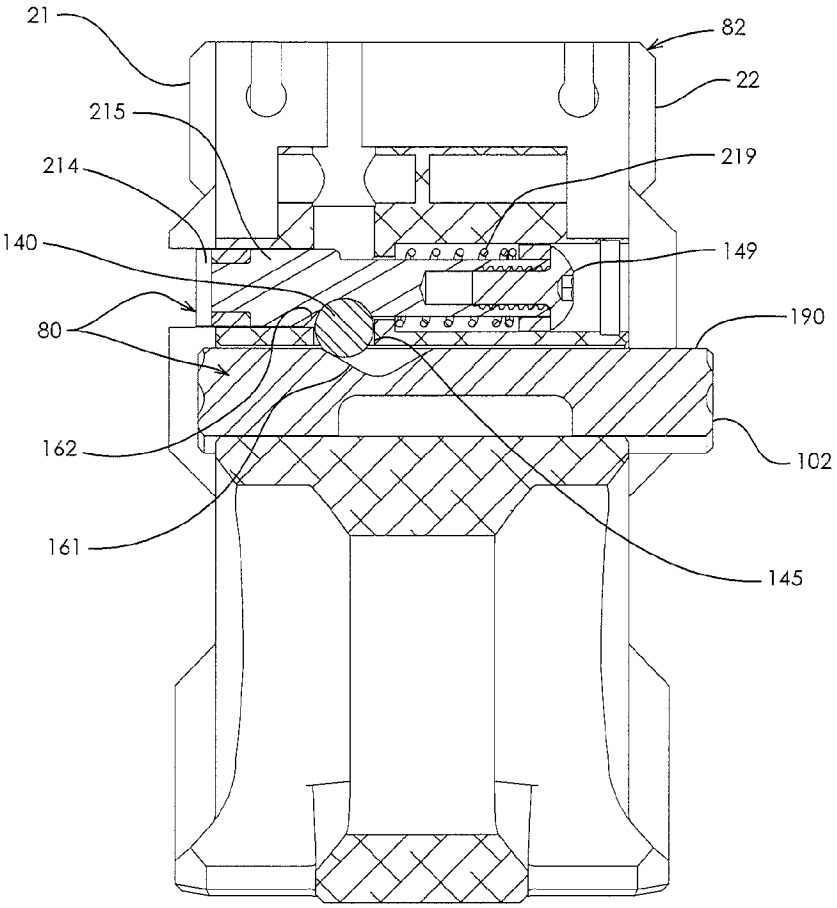
FIG. 18 is a cross-sectional rear view of the lower receiver of FIGS. 8-13, taken along section D-D in FIG. 17, showing, among other things, the left magazine release button depressed on the left side of the firearm.
Figure 17:
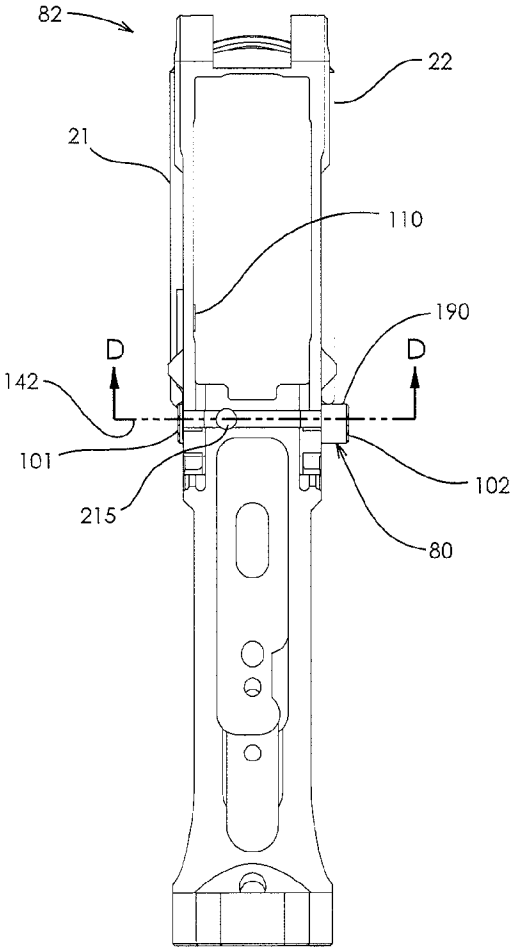
FIG. 17 is a cross-sectional top view of the lower receiver of FIGS. 8-13, taken along section A-A in FIG. 8, showing, among other things, the left magazine release button depressed on the left side of the firearm.
Figure 20:
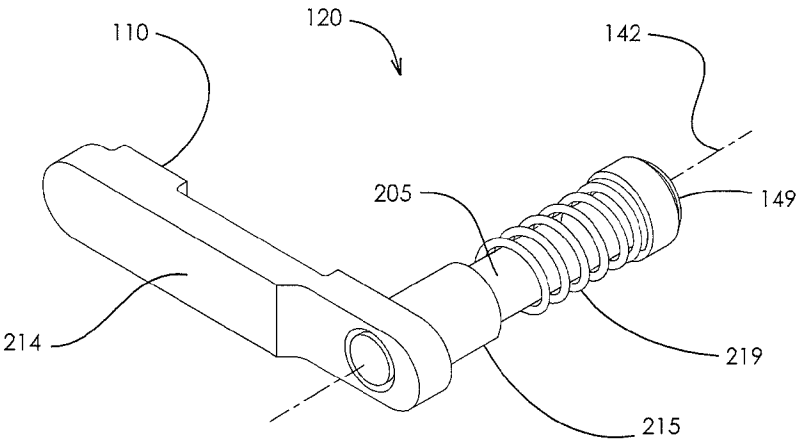
FIG. 20 is an isometric view of an elongated magazine catch member and an arm extending from the elongated magazine catch member of the magazine release mechanism of the embodiment illustrated in FIGS. 8-18.
Figure 21:
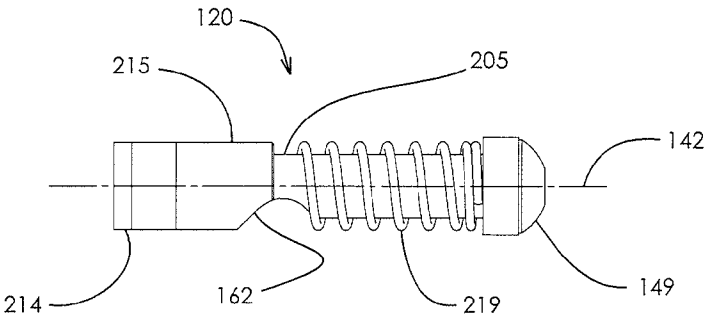
FIG. 21 is a front view of the elongated magazine catch member of FIG. 21 showing, among other things, the second indentation for the catch actuator.
Figure 19:
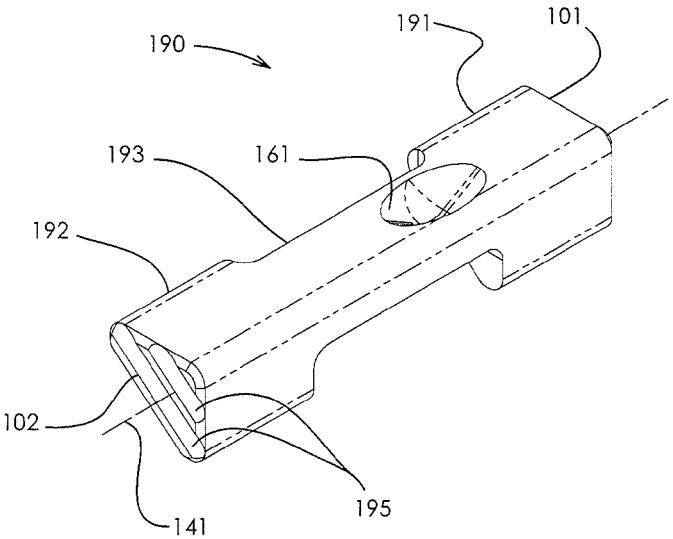
FIG. 19 is an isometric view of an elongated magazine release member of the magazine release mechanism of the embodiment illustrated in FIGS. 8-18 showing, among other things, the first indentation for the catch actuator.

Moreover, in a number of embodiments, the left magazine release button (e.g., 101) is directly opposite and in line with the right magazine release button (e.g., 102), for instance, as shown in FIG. 10. As used herein, "directly opposite and in line with" means facing a substantially opposite direction, within 5 degrees, and located in a substantially same position on the firearm (e.g., 10), for example, measured from the trigger (e.g., 15 shown in FIGS. 1-5) of the firearm, from the tip of the barrel (e.g., 13 shown in FIGS. 1-3), or from the highest point (e.g., 18 shown in FIGS. 1 and 3) on the upper receiver (e.g., 11), as examples. Further, as used herein, "substantially same position" means within plus or minus one quarter inch. In other embodiments, however, where a "substantially same position" is indicated herein, the measurements or position may be within 1/16, 1/8, 3/16, 3/8, 1/2, 5/8, 3/4, 7/8, 1, 1.25, 1.5, 1.75, or 2 inches, as other examples, or within 5, 10, 15, 20, 25, 30, 40, or 50 percent, as still other examples. Further, in some embodiments, the first user action and the second user action are substantially similar. Even further, in some embodiments, the first user action and the second user action are substantially similar but in opposite directions. Further still, as used herein, "opposite direction" means within 10 degrees of the exact opposite direction.

In certain embodiments, the first user action and the second user action are both pure translation. As used herein, "pure translation" means moving in a straight line, as opposed to pivoting around a pivot point. For example, as used herein, a piston moving in a cylinder is moving in pure translation. Variations from a straight line due to normal manufacturing clearances and tolerances are permissible in many embodiments, while still being considered, herein, to be pure translation. In some embodiments (e.g., in addition to including components of a firearm, such as recited above), the magazine release mechanism (e.g., 80) is configured such that pressing on the left magazine release button (e.g., 101) with a first user action causes the magazine catch (e.g., 110) to release the magazine (e.g., 90) from the receiver (e.g., the lower receiver 82), the magazine release mechanism (e.g., 80) is configured such that pressing on the right magazine release button (e.g., 102) with a second user action causes the magazine catch (e.g., 110) to release the magazine (e.g., 90) from the receiver, and the first user action and the second user action are both pure translation.

In some embodiments, the magazine release mechanism (e.g., 80) is configured such that pressing on the left magazine release button (e.g., 101) with the first user action causes the magazine catch (e.g., 110) to pull away from the magazine (e.g., 90), and the magazine release mechanism (e.g., 80) is configured such that pressing on the right magazine release button (e.g., 102) with the second user action causes the magazine catch (e.g., 110) to pull away from the magazine (e.g., 90). In other embodiments, as other examples, the magazine release mechanism is configured such that pressing on the left magazine release button with the first user action causes the magazine catch to pivot, and the magazine release mechanism is configured such that pressing on the right magazine release button with the second user action causes the magazine catch to pivot (e.g., away from the magazine). Other embodiments may differ.

Further, in various embodiments, the magazine release mechanism (e.g., 80) includes a spring (e.g., 219 shown in FIGS. 11, 14, 16, 18, 20, and 21), for instance, a return spring, and the spring (e.g., 219) that biases (e.g., pushes or pulls, in different embodiments, pushing in the embodiment shown) the magazine catch (e.g., 110), or a tab thereon, for instance, toward the magazine (e.g., 90), for example, into a slot or recess (e.g., 99) in the magazine (e.g., 90), for instance, when the magazine (e.g., 90) is attached to the receiver (e.g., lower receiver 82). In some embodiments, the spring (e.g., 219) is attached with a screw (e.g., 149).

Even further, in some embodiments in which the magazine release mechanism (e.g., 80) includes a spring (e.g., 219), the magazine release mechanism (e.g., 80) is configured such that pressing on the left magazine release button (e.g., 101) with the first user action causes a load on the spring (e.g., 219) to increase, the magazine release mechanism (e.g., 80) is configured such that pressing on the right magazine release button (e.g., 102) with the second user action causes the load on the spring (e.g., 219) to increase, or both. In various embodiments, pressing on either button causes the load to increase on the same spring (e.g., 219). Other embodiments, however, can have multiple springs, for example, two springs, and pressing one button can cause the load to increase on one or fewer than all of the springs, as other examples. The load on the spring (e.g., 219) can be increased, for example, by compressing a spring (e.g., 219) that is loaded in compression, or by stretching a spring (not shown) that is loaded in tension, as examples. In other embodiments, other types of springs may be used, however, for example, that are loaded in bending or in torsion, for instance, and that are loaded accordingly.

In particular embodiments, the left magazine release button (e.g., 101) and the right magazine release button (e.g., 102) are opposite ends of an elongated magazine release member (e.g., 190 shown in FIGS. 8-19), for example, that extends through the receiver (e.g., lower receiver 82), for instance, from the left side (e.g., 21) of the firearm (e.g., 10) to the right side (e.g., 22) of the firearm. As used herein, an "elongated" member has one overall dimension that is at least three times longer than any perpendicular overall dimension. In this context, however, an elongated member can be attached to other parts to which this definition does not apply and that are not included in these overall dimensions.

In certain embodiments, for example, a firearm (e.g., 10) includes a left side (e.g., 21), a right side (e.g., 22) opposite the left side (e.g., 21), a magazine (e.g., 90) that holds ammunition for the firearm, a receiver (e.g., lower receiver 82) to which the magazine (e.g., 90) attaches, a magazine catch (e.g., 110) that holds the magazine (e.g., 90) in the receiver (e.g., lower receiver 82) of the firearm, and a magazine release mechanism (e.g., 80) that releases the magazine catch (e.g., 110). In a number of embodiments, the magazine release mechanism (e.g., 80) includes a left magazine release button (e.g., 101) on the left side (e.g., 21) of the firearm, and a right magazine release button (e.g., 102) on the right side (e.g., 22) of the firearm, and the left magazine release button (e.g., 101) and the right magazine release button (e.g., 102) are opposite ends of an elongated magazine release member (e.g., 190) that extends through the receiver (e.g., lower receiver 82) from the left side (e.g., 21) of the firearm (e.g., 10) to the right side (e.g., 22) of the firearm. An example is illustrated.

Still further, in some embodiments, the firearm (e.g., 10) includes a barrel (e.g., 13 shown in FIGS. 1-3) having a barrel axis (i.e., the centerline of the barrel along which the bullet travels when the firearm (e.g., 10) is fired), and the magazine release member (e.g., 190) has a first long axis (e.g., 141 shown in FIGS. 14 and 19), and the first long axis is perpendicular to the barrel axis (e.g., within 10 degrees), for example, when the firearm (e.g., 10) is viewed from above. In some embodiments, the first long axis (e.g., 141) and the barrel axis are non-intersecting or skew lines, when considered in three dimensions, but are perpendicular, or at least substantially perpendicular, when viewed from above. Further, as used herein, directional words such as "above", "left side", and "right side" mean when the firearm (e.g., 10) is positioned in its normal orientation when being used, for instance, with the left side (e.g., 21) and the right side (e.g., 22) vertical and with the barrel (e.g., 13) axis horizontal. In a number of embodiments, in this orientation of the firearm, the first long axis (e.g., 141) of the magazine release member (e.g., 190) is horizontal.

Even further, as used herein, the first long axis (e.g., 141) of the magazine release member (e.g., 190) is parallel to the longest overall dimension of the magazine release member (e.g., 190) which is parallel to sides of the magazine release member (e.g., 190). As used herein, "parallel", without being preceded by "substantially", means parallel to within 5 degrees, unless stated otherwise. Further, as used herein, "substantially parallel" means parallel to within 10 degrees unless stated otherwise. Moreover, where "parallel" is used herein, in other embodiments, the items that are indicated to be parallel can be substantially parallel in the other embodiments, and where "substantially parallel" is used herein, in other embodiments, the items that are indicated to be substantially parallel can be parallel in the other embodiments. Still further, in some embodiments, these sides of the magazine release member are concentric with the long axis of the magazine release member. In various embodiments, these sides of the magazine release member are symmetrical (e.g., in whole or in part) with the long axis of the magazine release member. Still further, in various embodiments, the long axis (e.g., 141) of the magazine release member (e.g., 190) extends through (e.g., the center of) the left magazine release button (e.g., 101) on the left side (e.g., 21) of the firearm (e.g., 10), and the right magazine release button (e.g., 102) on the right side (e.g., 22) of the firearm.

Moreover, in a number of embodiments of a firearm (e.g., 10) having a magazine release member (e.g., 190) having a first long axis (e.g., 141), the first long axis (e.g., 141) is perpendicular to the left side (e.g., 21) of the firearm (e.g., 10) or of the receiver (e.g., lower receiver 82), the first long axis (e.g., 141) is perpendicular to the right side (e.g., 22), or both. Even further, in some embodiments of a firearm (e.g., 10) having a magazine release member (e.g., 190), pressing on the left magazine release button (e.g., 101) with the first user action causes the magazine release member (e.g., 190) to translate perpendicular to the left side (e.g., 21), pressing on the right magazine release button (e.g., 102) with the second user action causes the magazine release member (e.g., 190) to translate perpendicular to the right side (e.g., 22), or both, or vice versa. In certain embodiments, for example, the left side (e.g., 21) is parallel to, or at least substantially parallel to, the right side (e.g., 22). Even further still, in some embodiments of a firearm (e.g., 10) having a magazine release member (e.g., 190), pressing on the left magazine release button (e.g., 101) with the first user action causes the magazine release member (e.g., 190) to translate parallel to the first long axis (e.g., 141) of the magazine release member (e.g., 190), pressing on the right magazine release button (e.g., 102) with the second user action causes the magazine release member (e.g., 190) to translate parallel to the first long axis (e.g., 141) of the magazine release member (e.g., 190), or both.

In some embodiments, the magazine release member (e.g., 190) has a cross section (e.g., perpendicular to the first long axis (e.g., 141)) that is a triangle, for instance, with rounded corners, for example, a right triangle, such as a 45×45×90 degree triangle. See, for example, FIGS. 8, and 19. In other embodiments, the magazine release member (e.g., 190) has a cross section (e.g., perpendicular to the first long axis, for instance, 141) that is round, elliptical, oval, square, rectangular, pentagonal, hexagonal, octagonal, splined, polygonal, or a regular polygon, as examples, for instance, with rounded corners. Further, in some embodiments, the ends of the magazine release member (e.g., 190) (e.g., magazine release buttons 101 and 102) include texture or ridges (e.g., 195 shown in FIG. 19), groves, scallops, indentations, projections, or the like. In some embodiments, the ends (e.g., 191 and 192 shown in FIG. 19) of the magazine release member (e.g., 190), for example, proximate where the buttons (e.g., magazine release buttons 101 and 102) are located, are wider than an intermediate portion (e.g., 193) of the magazine release member.

In a number of embodiments of a firearm (e.g., 10) having a magazine release member (e.g., 190), for instance, having a first long axis (e.g., 141), the firearm (e.g., 10) or the magazine release mechanism (e.g., 80) further includes an elongated magazine catch member (e.g., 215 shown in FIGS. 8-18, 20, and 21) having a second long axis (e.g., 142 shown in FIGS. 13-15, 17, and 21), for instance, that is parallel to a first long axis (e.g., 141) of the magazine release member (e.g., 190). Further, in some embodiments, the second long axis (e.g., 142) of the elongated magazine catch member (e.g., 215), is perpendicular to the left side (e.g., 21), is perpendicular to the right side (e.g., 22), or both. in some embodiments, the second long axis (e.g., 142) of the elongated magazine catch member (e.g., 215), is substantially perpendicular to the left side (e.g., 21), is substantially perpendicular to the right side (e.g., 22), or both. In various embodiments, pressing on the left magazine release button (e.g., 101) with the first user action causes the magazine catch (e.g., 110) member to translate perpendicular to the left side (e.g., 21), pressing on the right magazine release button (e.g., 102) with the second user action causes the magazine catch (e.g., 110) member to translate perpendicular to the right side (e.g., 22), or both.

In various embodiments, a firearm (e.g., 10) or a magazine release mechanism (e.g., 80) includes an elongated magazine release member (e.g., 190) and an elongated magazine catch member (e.g., 215), for instance, that is parallel to the elongated magazine release member (e.g., 190), the elongated magazine release member (e.g., 190) and the elongated magazine catch member (e.g., 215) are each substantially perpendicular to the left side (e.g., 21) and to the right side (e.g., 22), or both. In a number of embodiments, for example, a firearm (e.g., 10) includes a magazine (e.g., 90) that holds ammunition for the firearm, a receiver (e.g., lower receiver 82) to which the magazine (e.g., 90) attaches, a left side (e.g., 21), a right side (e.g., 22) opposite the left side (e.g., 21), a magazine catch (e.g., 110) that holds the magazine (e.g., 90) in the receiver (e.g., lower receiver 82) of the firearm, and a magazine release mechanism (e.g., 80). Further, in a number of embodiments, the magazine release mechanism (e.g., 80) includes an elongated magazine release member (e.g., 190) and an elongated magazine catch member (e.g., 215) that is parallel to the elongated magazine release member (e.g., 190), and the elongated magazine release member (e.g., 190) and the elongated magazine catch member (e.g., 215) are each substantially perpendicular to the left side (e.g., 21) and to the right side (e.g., 22) of the firearm (e.g., 10) or of the receiver or lower receiver (e.g., 82). Further, in various embodiments, the magazine release mechanism (e.g., 80) is configured such that pressing on the magazine release member (e.g., 190) at the left side (e.g., 21) causes the magazine catch (e.g., 110) to release the magazine (e.g., 90), for example, from the receiver (e.g., 82), and the magazine release mechanism (e.g., 80) is configured such that pressing on the magazine release member (e.g., 190) at the right side (e.g., 22) causes the magazine catch (e.g., 110) to release the magazine (e.g., 90), for instance, from the receiver.

In a number of embodiments having an elongated magazine release member (e.g., 190) and an elongated magazine catch member (e.g., 215), the firearm (e.g., 10) or the magazine release mechanism (e.g., 80) further includes a catch actuator (e.g., 140 shown, for example, in FIGS. 14, 16, and 18), for example, located between the elongated magazine release member (e.g., 190) and the elongated magazine catch member (e.g., 215). In particular embodiments, for example, a firearm (e.g., 10) includes a left side (e.g., 21), a right side (e.g., 22) opposite the left side (e.g., 21), a magazine (e.g., 90) that holds ammunition for the firearm, a receiver (e.g., lower receiver 82) to which the magazine (e.g., 90) attaches, a magazine catch (e.g., 110) that holds the magazine (e.g., 90) in the receiver (e.g., lower receiver 82) of the firearm, and a magazine release mechanism (e.g., 80) that releases the magazine catch (e.g., 110). Further, in various embodiments, the magazine release mechanism (e.g., 80) includes a left magazine release button (e.g., 101) on the left side (e.g., 21) of the firearm, a right magazine release button (e.g., 102) on the right side (e.g., 22) of the firearm, an elongated magazine release member (e.g., 190) (e.g., extending from the left magazine release button (e.g., 101) to the right magazine release button (e.g., 102)), an elongated magazine catch member (e.g., 215), and a catch actuator (e.g., 140) located between the elongated magazine release member (e.g., 190) and the elongated magazine catch member (e.g., 215).

In some embodiments having a catch actuator (e.g., 140), the catch actuator (e.g., 140) is a ball. In other embodiments having a catch actuator (e.g., 140), on the other hand, the catch actuator (e.g., 140) is a pin. Further, in some embodiments having an elongated magazine release member (e.g., 190), an elongated magazine catch member (e.g., 215), and a catch actuator (e.g., 140), the firearm (e.g., 10) or the magazine release mechanism (e.g., 80) further includes a guide (e.g., 145 shown, for example, in FIGS. 14, 16, and 18), for example, located between the elongated magazine release member (e.g., 190) and the elongated magazine catch member (e.g., 215). In a number of embodiments, the guide (e.g., 145) is stationary, for example, with respect to the left side (e.g., 21), the right side (e.g., 22), or both. In some embodiments, the guide (e.g., 145) is a wall between the magazine release member (e.g., 190) and the magazine catch (e.g., 110) member, for example, with a hole through the guide, for instance, containing the catch actuator (e.g., 140), or part thereof, or through which the catch actuator (e.g., 140) moves, or both. Further still, in various embodiments, the guide (e.g., 145) directs or guides motion of the catch actuator (e.g., 140), for example, when the magazine release member (e.g., 190) moves. In some embodiments, the catch actuator (e.g., 140) moves, for instance, perpendicularly or substantially perpendicularly to the motion of magazine release member (e.g., 190), perpendicularly or substantially perpendicularly to the motion of magazine catch (e.g., 110) member, or a combination thereof, as examples.

In a number of embodiments of a firearm (e.g., 10) having an elongated magazine release member (e.g., 190) and a catch actuator (e.g., 140), the firearm (e.g., 10) or the magazine release mechanism (e.g., 80) further includes a first indentation (e.g., 161 shown, for example, in FIGS. 14, 16, 18, and 19) within the elongated magazine release member (e.g., 190) for the catch actuator (e.g., 140). In various embodiments, the catch actuator (e.g., 140) fits inside, or partially inside, the first indentation (e.g., 161) in the magazine release member (e.g., 190), and when the magazine release member (e.g., 190) moves (e.g., in either direction), for instance, when one of the magazine release buttons (e.g., 101 or 102) is pressed, the sides of the first indentation (e.g., 161) push the catch actuator (e.g., 140), for example, out of or partially out of the first indentation (e.g., 161), for instance, through the guide (e.g., 145), for example, perpendicular or substantially perpendicular to the motion of the magazine release member (e.g., 190).

Further, in a number of embodiments of a firearm (e.g., 10) having an elongated magazine catch member (e.g., 215) and a catch actuator (e.g., 140), the firearm (e.g., 10) or the magazine release mechanism (e.g., 80) further includes a second indentation (e.g., 162 shown, for example, in FIGS. 14, 16, 18, and 21), for example, within the elongated magazine catch member (e.g., 215), for instance, for the catch actuator (e.g., 140). In various embodiments, when the catch actuator (e.g., 140) is pushed out of the first indentation (e.g., 161) by motion of the magazine release member (e.g., 190), for instance, in either direction (e.g., left or right), and the catch actuator (e.g., 140) passes through the guide (e.g., 145) into, or at least partially into, the second indentation (e.g., 162). In so doing, the catch actuator (e.g., 140), in various embodiments, presses against one side of the second indentation (e.g., 162), within the elongated magazine catch member (e.g., 215), which pushes the elongated magazine catch member (e.g., 215) in one direction releasing the magazine catch (e.g., 110). In this process, in some embodiments, the catch actuator (e.g., 140) moves, for example, in part, or to a greater extent, upon motion of the magazine release member (e.g., 190), into the second indentation (e.g., 162).

In a number of embodiments, motion of the magazine release member (e.g., 190), in either direction, causes (e.g., via catch actuator 140, guide 145, first indentation 161, and second indentation 162) the magazine release member (e.g., 190), to move in just one direction, retracting the magazine catch (e.g., 110), for example, and releasing the magazine (e.g., 90). In this manner, the operator can release the magazine (e.g., 90) by pressing either the left magazine release button (e.g., 101) on the left side (e.g., 21) of the firearm, or the right magazine release button (e.g., 102) on the right side (e.g., 22) of the firearm, for example, with a substantially equal motion, in the same location on opposite sides of the firearm or both. In various embodiments, where indentations (e.g., 161, 162, or both) are described herein, one or more ramps may be provided, for example, either internal or external with respect to the magazine release member or the magazine catch member, for instance.

Further still, in various embodiments of a firearm (e.g., 10) having a magazine catch member (e.g., 215), the firearm (e.g., 10) or the magazine release mechanism (e.g., 80) further includes a spring (e.g., 219), for instance, that is concentric with the (e.g., elongated) magazine catch member (e.g., 215). In some embodiments, for instance, the spring (e.g., 219) is a helical spring (e.g., 219). In some embodiments, for example, the spring (e.g., 219) is loaded in compression, and pushes the elongated magazine catch member (e.g., 215) so that the magazine catch (e.g., 110) engages the slot or recess (e.g., 99) in the magazine (e.g., 90) to retain the magazine (e.g., 90), for instance, in the receiver (e.g., 82). Motion of the elongated magazine catch member (e.g., 215), in various embodiments, caused by motion of the catch actuator (e.g., 140), which in turn is cause by motion of the magazine release member (e.g., 190), compresses the spring (e.g., 219) and releases the magazine catch (e.g., 110).

Even further, in a number of embodiments of a firearm (e.g., 10) having an elongated magazine catch member (e.g., 215), the firearm (e.g., 10) or the magazine release mechanism (e.g., 80) includes an arm (e.g., 214), for instance, extending from the elongated magazine catch member (e.g., 215) to the magazine catch (e.g., 110). In some embodiments the arm (e.g., 214) is part of or integral with the magazine catch (e.g., 110), the magazine catch member (e.g., 215), or both. In this context, however, the catch member (e.g., 215) is considered herein to be elongated, even if the arm (e.g., 214) is integral with the magazine catch member (e.g., 215). Thus, as used herein, for purposes of determining whether the catch member (e.g., 215) is elongated, the arm (e.g., 214) is not considered to be part of the magazine catch member (e.g., 215). Further, in some embodiments, the arm (e.g., 214) is attached to the magazine catch (e.g., 110) or the magazine catch member (e.g., 215), for example, with threads, with an interference fit, with an adhesive, with a faster such as a screw, with a pin, with a snap ring, or with a weld, as examples.

In some embodiments, the magazine catch member (e.g., 215), for instance, excluding the arm (e.g., 214) and the second indentation (e.g., 162), has a cross section that is round or circular. In some embodiments, a portion (e.g., 205) of the magazine catch member (e.g., 215) has a smaller diameter (e.g., 205), for example, to provide room for the spring (e.g., 219). Other embodiments may differ. Further still, in some embodiments, the magazine catch (e.g., 110) is located on or is part of the arm (e.g., 214). In some embodiments, for instance, the magazine catch (e.g., 110) is a projection from the arm (e.g., 214), for example, that extends into, or engages, an indentation or slot (e.g., 99) in the magazine (e.g., 90). Even further, in some embodiments, the spring (e.g., 219) is attached to or retained by a fastener, such as a retaining screw (e.g., 149), for instance, that extends into (e.g., concentric with) the magazine catch member (e.g., 215). In some embodiments, the spring (e.g., 219) presses against part of the receiver, for example, the lower receiver (e.g., 82), for instance, the guide (e.g., 145) or proximate to the guide (e.g., 145) or hole through the guide (e.g., 145).

Different embodiments include an ambidextrous bolt release mechanism, an ambidextrous magazine release mechanism, or both, for example, as described herein. Further, some embodiments that include an ambidextrous bolt release mechanism also include an ambidextrous bolt engagement mechanism. Various firearms (e.g., 10) each include, for example, a bolt, a carrier or both (e.g., 68), a bolt catch (e.g., 60) that holds the bolt or the carrier (e.g., 68) in a retracted position, a left bolt release feature (e.g., 61) at the left side (e.g., 21) of the firearm, and a right bolt release feature (e.g., 62) at the right side (e.g., 22, for instance, opposite the left side) of the firearm (e.g., 10). In a number of embodiments, the left bolt release feature (e.g., 61) is actuated with a first user action to release the bolt catch (e.g., 60), and the right bolt release feature (e.g., 62) is actuated with a second user action to release the bolt catch (e.g., 60). As used herein, a user action can be, for example, application of a force, such as a pushing force, which can be defined, for example, by a magnitude and a direction of application. Further, in various embodiments, the first user action and the second user action are substantially similar but in opposite directions.

Some embodiments further include a left bolt engagement feature (e.g., 63) at the left side (e.g., 21) and a right bolt engagement feature (e.g., 64) at the right side (e.g., 22). Moreover, in a number of embodiments, the left bolt engagement feature (e.g., 63) is actuated with a third user action, and the right bolt engagement feature (e.g., 64) is actuated with a fourth user action. In some embodiments, for example, the third user action and the fourth user action are substantially similar but in opposite directions. Further, in particular embodiments, the first user action is an application of a first pushing force, for example, substantially perpendicular to the left side (e.g., 21) of the firearm (e.g., 10) and the second user action is an application of a second pushing force, for instance, substantially perpendicular to the right side (e.g., 22) of the firearm.

Still further, in certain embodiments, the left bolt release feature (e.g., 61) includes a left bolt release pad (e.g., 61) at the left side (e.g., 21), the right bolt release feature (e.g., 62) includes a right bolt release pad (e.g., 62) at the right side (e.g., 22), and the left bolt release pad (e.g., 61) is substantially opposite the right bolt release pad (e.g., 62). Moreover, in some embodiments, the left bolt release feature (e.g., 61) is a left bolt release pad (e.g., 61) at the left side (e.g., 21), and the right bolt release feature (e.g., 62) is a right bolt release pad (e.g., 62) at the right side (e.g., 22). Similarly, in some embodiments, the left bolt engagement feature (e.g., 63) is substantially opposite the right bolt engagement feature (e.g., 64). Further still, in some embodiments, the third user action is an application of a third pushing force, for example, substantially perpendicular to the left side (e.g., 21) of the firearm (e.g., 10) and the fourth user action is an application of a fourth pushing force, for instance, substantially perpendicular to the right side (e.g., 22) of the firearm.

Even further, in a number of embodiments, the bolt catch (e.g., 60) includes a left lever (e.g., 65) that extends to the left side (e.g., 21) of the firearm (e.g., 10) and a right lever (e.g., 66) that extends to the right side (e.g., 22) of the firearm. Even further still, in certain embodiments, the bolt catch (e.g., 60) includes a left pivot point (e.g., 75) of the left lever (e.g., 65), and the left lever (e.g., 65) rotates about the left pivot point (e.g., 75) when the left lever (e.g., 65) is actuated. In some embodiments, for example, the left pivot point (e.g., 75) is between the left side (e.g., 21) and the right side (e.g., 22). Further, in particular embodiments, the left pivot point (e.g., 75) is closer to the left side (e.g., 21) than the right side (e.g., 22). Similarly, in some embodiments, the bolt catch (e.g., 60) includes a right pivot point (e.g., 76) of the right lever (e.g., 66), and the right lever (e.g., 66) rotates about the right pivot point (e.g., 76) when the right lever (e.g., 66) is actuated. In a number of embodiments, for instance, the right pivot point (e.g., 76) is between the left side (e.g., 21) and the right side (e.g., 22). Further, in some embodiments, the right pivot point (e.g., 76) is closer to the right side (e.g., 22) than the left side (e.g., 21). Moreover, in some embodiments, the left lever (e.g., 65) engages the bolt or carrier and the right lever (e.g., 66) engages the left lever (e.g., 65). In other embodiments, however, the right lever (e.g., 66) engages the bolt or carrier and the left lever (e.g., 65) engages the left lever (e.g., 65). The figures illustrate an example.

Other embodiments include various firearms (e.g., 10) that include, for example, an ammunition magazine (e.g., 90) that holds ammunition for the firearm, a receiver (e.g., lower receiver 82) to which the ammunition magazine (e.g., 90) attaches, a magazine catch (e.g., 110) that attaches the ammunition magazine (e.g., 90) to the receiver (e.g., lower receiver 82) of the firearm, and a magazine release mechanism (e.g., 80) that releases the magazine catch (e.g., 110). In a number of embodiments, the magazine release mechanism (e.g., 80) includes a left magazine release button (e.g., 101) on the left side (e.g., 21) of the firearm (e.g., 10) and a right magazine release button (e.g., 102) on the right side (e.g., 22) of the firearm. Moreover, in various embodiments, the magazine release mechanism (e.g., 80) is configured so that pressing on the left magazine release button (e.g., 101) with a first user action causes the magazine catch (e.g., 110) to release the ammunition magazine (e.g., 90) from the receiver. Similarly, in a number of embodiments, the magazine release mechanism (e.g., 80) is configured so that pressing on the right magazine release button (e.g., 102) with a second user action causes the magazine catch (e.g., 110) to release the ammunition magazine (e.g., 90) from the receiver. Further, in various embodiments, the left magazine release button (e.g., 101) is directly opposite and in line with the right magazine release button (e.g., 102).

Further, in some embodiments, the first user action and the second user action are substantially similar but in opposite directions. Still further, in a number of embodiments, the left magazine release button (e.g., 101) and the right magazine release button (e.g., 102) are opposite ends of an elongated magazine release member (e.g., 190), for example, that extends through the receiver from the left side (e.g., 21) of the firearm (e.g., 10) to the (e.g., opposite) right side (e.g., 22) of the firearm. Further still, some embodiments include an elongated magazine catch member (e.g., 215) having a second long axis (e.g., 142), for instance, that is parallel to a first long axis (e.g., 141) of the magazine release member (e.g., 190). Even further, certain embodiments include a catch actuator (e.g., 140), for example, located between the elongated magazine release member (e.g., 190) and the elongated magazine catch member (e.g., 215). In different embodiments, for example, the catch actuator (e.g., 140) consists of (i.e., is) a ball (i.e., a sphere) or a pin (e.g., a right circular cylinder). In a number of embodiments, the catch actuator is solid, for example.)

Still further, various embodiments include a guide (e.g., 145), for example, located between the elongated magazine release member (e.g., 190) and the elongated magazine catch member (e.g., 215). In a number of embodiments, for instance, the guide (e.g., 145) is stationary with respect to the left side (e.g., 21) and the right side (e.g., 22) of the firearm, and the guide (e.g., 145) guides motion of the catch actuator (e.g., 140) when the magazine release member (e.g., 190) moves. In some embodiments, for example, the guide (e.g., 145) is a hole or a passageway, for instance, through part of the lower receiver (e.g., 82).

Even further still, in some embodiments, there is a first indentation (e.g., 161) within the elongated magazine release member (e.g., 190) for the catch actuator (e.g., 140), a second indentation (e.g., 162) within the elongated magazine catch member (e.g., 215) for the catch actuator (e.g., 140), or both. Moreover, certain embodiments include a spring (e.g., 219), for example, a return spring, for instance, that is concentric with the elongated magazine catch member (e.g., 215). In a number of embodiments, the spring (e.g., 219) biases the magazine catch (e.g., 110) into a slot (e.g., 99) in the magazine (e.g., 90) to retain the magazine in the receiver (e.g., lower receiver 82). Furthermore, some embodiments include an arm (e.g., 214), for example, extending from the elongated magazine catch member (e.g., 215) to the magazine catch (e.g., 110).

Still further embodiments include firearms (e.g., 10) that include magazine release buttons (e.g., 101 and 102) on opposite sides (e.g., 21 and 22) that are substantially opposite, and catch release pads (e.g., 61 and 62) on opposite sides that are substantially opposite. Various such embodiments include an ammunition magazine (e.g., 90) that holds ammunition for the firearm, a receiver (e.g., lower receiver 12 or 82) to which the ammunition magazine (e.g., 90) attaches, a magazine catch (e.g., 110) that attaches the ammunition magazine (e.g., 90) to the receiver (e.g., lower receiver 12 or 82) of the firearm, and a magazine release mechanism (e.g., 80) that releases the magazine catch (e.g., 110). Further, a number of embodiments include a left magazine release button (e.g., 101) on the left side (e.g., 21) of the firearm, a right magazine release button (e.g., 102) on the right side (e.g., 22) of the firearm, a bolt catch (e.g., 60) that holds the bolt or the carrier (e.g., 68) in a retracted position, a left bolt release feature (e.g., 61) pad on the left side (e.g., 21) of the firearm, and a right bolt release feature (e.g., 62) pad on the right side (e.g., 22) of the firearm.

Still further, in various embodiments, pressing on the left magazine release button (e.g., 101) causes the magazine catch (e.g., 110) to release the ammunition magazine (e.g., 90) from the receiver, pressing on the right magazine release button (e.g., 102) causes the magazine catch (e.g., 110) to release the ammunition magazine (e.g., 90) from the receiver, pressing on the left bolt release feature (e.g., 61) pad causes the bolt catch (e.g., 60) to release the bolt or the carrier (e.g., 68) from the retracted position, and pressing on the right bolt release feature (e.g., 62) pad causes the bolt catch (e.g., 60) to release the bolt or the carrier (e.g., 68) from the retracted position. Even further, in a number of embodiments, the left magazine release button (e.g., 101) is substantially opposite the right magazine release button (e.g., 102), and the left bolt release pad (e.g., 61) is substantially opposite the right bolt release pad (e.g., 62).

Turning now from firearms (e.g., 10) and components thereof to methods, in various embodiments, particular methods can include acts of obtaining or providing, as examples, other features, components, or aspects described herein. All possible combinations are contemplated. Further, methods described herein contain various acts. The order in which these acts are described herein may be an example of the order in which these acts can be performed, but in other embodiments, unless stated otherwise herein, the acts may be performed in a different order. In some embodiments, acts may overlap or be performed at the same time, as another example.

Examples of methods include various methods of catching or releasing (or both) a bolt, carrier, or bolt carrier group (e.g., 68) of a firearm. Further examples include methods of making a firearm (e.g., 10) easier to use by different people. Such methods can include, for example, acts of obtaining, providing, or manufacturing a firearm (e.g., 10) having a bolt catch (e.g., 60). In a number of embodiments, the bolt catch (e.g., 60) can be engaged and released from either side (e.g., 21 and 22) of the firearm, for instance, using the same or a substantially similar motion on either side of the firearm. As used herein, "the same or a substantially similar motion on either side of the firearm" means forces (i.e., minimum forces required) applied by the user or operator, for instance, to engage or release the bolt catch (e.g., 60) are in substantially opposite directions (e.g., both pushing motions, but on opposite sides of the firearm) and are substantially similar in magnitude. As used herein, "substantially opposite directions" means opposite to within 30 degrees.

Another example is a method of making a firearm (e.g., 10) easier to be used by different people, the method comprising obtaining, providing, or manufacturing a firearm (e.g., 10) having a bolt catch (e.g., 60) wherein the bolt catch (e.g., 60) can be engaged and released from either side of the firearm (e.g., 10) using levers, pads, or other features that look, feel, or operate similarly (or a combination thereof) on both sides of the firearm. As used herein, looking similarly, means having a similar size and shape. As used herein, having a similar size and shape means the same size and shape within 25 percent (of the major dimension) of identical, or opposite hand thereof. In other embodiments, however, where "a similar size and shape" is used herein, the same size and shape may occur within 5, 10, 15, 20, 30, 35, 40, 45, 50, 60, 70, 80, 90, or 100 percent of identical or opposite hand, as other examples.

Further, as used herein, "feeling similarly" means that the features contacted by the operator when the operator contacts them are within 25 percent (of the major dimension) of identical or opposite hand and that the force applied to those features by the operator are in substantially opposite directions (e.g., both pushing motions, but on opposite sides of the firearm) and are substantially similar in magnitude. In other embodiments, where "feeling similarly" is used herein, the features contacted by the operator when the operator contacts them are within 5, 10, 15, 20, 30, 35, 40, 45, 50, 60, 70, 80, 90 or 100 percent of identical or opposite hand, as other examples. Further, operating similarly, as used herein, means requiring forces to operate that are in the same or substantially opposite directions (e.g., both pushing motions, but on opposite sides of the firearm) and are substantially similar in magnitude.)

A further example is a method of making a firearm (e.g., 10) easier to used by different people, the method including obtaining, providing, or manufacturing the firearm (e.g., 10) having a bolt catch (e.g., 60) wherein the bolt catch (e.g., 60) can be engaged and released from either side of the weapon using two levers that are located substantially within the firearm. As used herein, a component being "located substantially within the firearm" means that a majority of the component (e.g., by weight or volume) is located within the firearm (e.g., 10), for instance, between the left side (e.g., 21) and the right side (e.g., 22), or a plane formed thereby, for instance, within the lower receiver (e.g., 12). Various methods can further include acts of obtaining, providing, or manufacturing other components described herein, shown on the drawings, or both.

Further examples include various methods of releasing a magazine (e.g., 90) from a firearm (e.g., 10), and methods of making a firearm (e.g., 10) easier to use by different people. Such methods can include, for example, acts of obtaining, providing, or manufacturing a firearm (e.g., 10) having a magazine release mechanism (e.g., 80) wherein the magazine (e.g., 90) can be released from either side of the firearm (e.g., 10) using the same or a substantially similar motion on either side of the firearm.

In some embodiments, a method of making a firearm (e.g., 10) easier to be used by different people includes obtaining, providing, or manufacturing the firearm (e.g., 10) having a magazine release mechanism (e.g., 80) wherein the magazine (e.g., 90) can be released from either side of the firearm (e.g., 10) by pressing buttons that look, feel, and operate similarly on both sides of the firearm. Another example of a method of making a firearm (e.g., 10) easier to used by different people includes obtaining, providing, or manufacturing the firearm (e.g., 10) having a magazine release mechanism (e.g., 80) wherein the magazine (e.g., 90) can be released from either side of the weapon using two elongated parallel members (e.g., 190 and 215) that are located substantially within the firearm.

Yet another embodiment is a magazine (e.g., 90) release for a firearm, wherein the magazine release mechanism (e.g., 80) includes a left button (e.g., 101) and a right button (e.g., 102), the left button is actuated with a first user action, the right button is actuated with a second user action, and the first user action and the second user action are substantially similar but in opposite directions. Moreover, various methods, magazine (e.g., 90) releases, magazine release mechanisms (e.g., 80), or a combination thereof, further include a combination of the features described herein or one or more acts of manufacturing, obtaining, or providing, a combination of the features described herein. All conceivable combinations are contemplated.

In a number of embodiments, the firearm (e.g., 10) is a rifle. In particular embodiments, for example, the firearm (e.g., 10) is an assault rifle, such as an AR-15 or an M-16. In some embodiments, the firearm (e.g., 10) can be a semi-automatic firearm (e.g., 10) or a fully automatic firearm, as examples. Further, in particular embodiments, the firearm is a rifle configured to selectably (e.g., via operation of a selector lever) fire in a fully-automatic mode and in a semi-automatic mode. Other embodiments, however, may differ. For instance, in particular embodiments the firearm (e.g., 10) can be a pistol.

If there are any conflicts or inconsistencies between this patent application and the patent applications incorporated by reference, this patent application governs herein. Certain embodiments include combinations of features described herein and in one or more of these different patent applications. All conceivable and feasible combinations of such features are contemplated herein including all conceivable and feasible combinations of the subject matter described herein and described in these different patent applications. For example, other embodiments contemplated include each of the embodiments described herein further including one or more of the embodiments described in one or more of these different patent applications.

Further, various embodiments of the subject matter described herein include various combinations of the acts, structure, components, and features described herein, shown in the drawings, described in documents that are incorporated by reference herein, or that are known in the art. Moreover, certain procedures can include acts such as manufacturing, obtaining, or providing components that perform functions described herein or in the documents that are incorporated by reference. The subject matter described herein also includes various means for accomplishing the various functions or acts described herein, in the documents that are incorporated by reference, or that are apparent from the structure and acts described. Each function described herein is also contemplated as a means for accomplishing that function, or where appropriate, as a step for accomplishing that function.

Further, as used herein, the word "or", except where indicated otherwise, does not imply that the alternatives listed are mutually exclusive. Even further, where alternatives are listed herein, it should be understood that in some embodiments, fewer alternatives may be available, or in particular embodiments, just one alternative may be available, as examples.

What is claimed is:

1. A firearm comprising:
- a left side;
- a right side opposite the left side;
- at least one of a bolt or a carrier;
- a bolt catch that holds the bolt or the carrier in a retracted position;
- a left bolt release feature at the left side;
- and a right bolt release feature at the right side;
- wherein the left bolt release feature is actuated with a first user action to release the bolt catch;
- wherein the right bolt release feature is actuated with a second user action to release the bolt catch;
- wherein the first user action and the second user action are in opposite directions;
- a left bolt engagement feature at the left side;
- a right bolt engagement feature at the right side;
- wherein the left bolt engagement feature is actuated with a third user action;
- wherein the right bolt engagement feature is actuated with a fourth user action; and
- wherein the third user action and the fourth user action are in opposite directions.

2. The firearm of claim 1 wherein the first and second user actions are at a common vertical level.

3. The firearm of claim 1 wherein the third and fourth user actions are at a common vertical level.

4. A firearm with an ambidextrous bolt control comprising:
- a frame defining an bolt passage and opposed right and left sides;
- a bolt operable to reciprocate in the bolt passage between a forward battery position and a rearward retracted position;
- a bolt catch attached to the frame;
- the bolt catch having a bolt engagement portion proximate the bolt passage;
- the bolt catch being movable between a restraint position in which the bolt engagement portion extends into the passage to retrain the bolt in the retracted position, and a release position in which the bolt engagement portion is clear of the passage to enable the bolt to move from the rearward retracted position to the forward battery position;
- the bolt catch having a primary release actuation surface exposed on a selected one of the right and left sides of the frame;
- a secondary bolt catch actuator connected to the frame and movable between a first position and a second position;

the secondary bolt catch actuator having a secondary release actuation surface exposed on the opposite side of the frame from the primary release actuation surface;

wherein the primary release actuation surface and the secondary release actuation surface are symmetrically positioned vertically in registration with each other on opposite sides of the frame;

the secondary bolt catch actuator being operably engaged to the bolt catch; and the bolt catch being responsive to movement of the secondary bolt catch actuator from the first position to the second position to move from the restraint position to the release position, such that the bolt may be released from either side of the rifle.

* * * * *